US009162505B2

(12) United States Patent
Sugahara

(10) Patent No.: US 9,162,505 B2
(45) Date of Patent: Oct. 20, 2015

(54) PRINTER

(75) Inventor: Hiroto Sugahara, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 662 days.

(21) Appl. No.: 12/553,506

(22) Filed: Sep. 3, 2009

(65) Prior Publication Data

US 2010/0060693 A1 Mar. 11, 2010

(30) Foreign Application Priority Data

Sep. 11, 2008 (JP) ..... 2008-233019

(51) Int. Cl.

| | |
|---|---|
| ***B41J 29/38*** | (2006.01) |
| ***B41J 3/60*** | (2006.01) |
| ***B41J 11/04*** | (2006.01) |
| ***B41J 13/00*** | (2006.01) |
| ***B41J 13/22*** | (2006.01) |

(52) U.S. Cl.

CPC .. *B41J 29/38* (2013.01); *B41J 3/60* (2013.01); *B41J 11/04* (2013.01); *B41J 13/009* (2013.01); *B41J 13/223* (2013.01)

(58) Field of Classification Search

CPC ..... B41J 11/42; B41J 29/393; B41J 29/38; B41J 3/60; B41J 11/0095

USPC ..... 347/16, 102

See application file for complete search history.

(56) References Cited

U.S. PATENT DOCUMENTS

| | | | | |
|---|---|---|---|---|
| 4,440,388 | A * | 4/1984 | Divoux et al. | 271/195 |
| 5,771,054 | A | 6/1998 | Dudek et al. | |
| 5,781,823 | A * | 7/1998 | Isobe et al. | 399/2 |
| 5,913,268 | A * | 6/1999 | Jackson et al. | 101/420 |
| 6,092,894 | A * | 7/2000 | Nuita et al. | 347/104 |
| 6,460,991 | B1 | 10/2002 | Temple et al. | |
| 6,682,191 | B2 | 1/2004 | Temple et al. | |
| 7,360,857 | B2 * | 4/2008 | Koshikawa | 347/16 |
| 8,277,013 | B2 * | 10/2012 | Sugahara | 347/16 |
| 2005/0099480 | A1 * | 5/2005 | Saito et al. | 347/104 |
| 2005/0275672 | A1 * | 12/2005 | Koshikawa | 347/5 |
| 2006/0176352 | A1 * | 8/2006 | Mihara et al. | 347/104 |
| 2006/0221780 | A1 * | 10/2006 | Sugahara | 369/30.01 |
| 2007/0091135 | A1 * | 4/2007 | Hosaka et al. | 347/15 |
| 2008/0129801 | A1 * | 6/2008 | Umeda et al. | 347/85 |

(Continued)

FOREIGN PATENT DOCUMENTS

| | | | |
|---|---|---|---|
| JP | 8323977 | 12/1996 | |
| JP | 2001-031309 | 2/2001 | |
| JP | 2001-514107 | 9/2001 | |
| JP | 2001-293858 | 10/2001 | |
| JP | 2003154643 A * | 5/2003 | B41J 2/01 |

(Continued)

*Primary Examiner* — Manish S Shah
*Assistant Examiner* — Yaovi Ameh
(74) *Attorney, Agent, or Firm* — Frommer Lawrence & Haug LLP

(57) ABSTRACT

There is provided a printer including: an ink-jet head; a first rotatable body; a first attaching mechanism attaching a printing medium to the first rotatable body; a separating mechanism separating the printing medium from the first rotatable body; and a control mechanism. In the printer, first to forth routes are formed. In transporting the printing medium, the control mechanism causes the printing medium having been subjected to printing on a first surface by the ink-jet head to pass through the first route, next to pass through the second route and the third route at least once, thereafter to separate from the first rotatable body, and further to pass through the fourth route to be reversed.

13 Claims, 19 Drawing Sheets

(56) References Cited

U.S. PATENT DOCUMENTS

2010/0060692 A1* 3/2010 Sugahara ..... 347/16
2010/0060693 A1* 3/2010 Sugahara ..... 347/16

FOREIGN PATENT DOCUMENTS

JP 2003205657 A * 7/2003 ..... B41J 13/00
JP 2008-179012 8/2008

* cited by examiner

PRINTER

CROSS REFERENCE TO RELATED APPLICATION

The present application claims priority from Japanese Patent Application No. 2008-233019, filed on Sep. 11, 2008 the disclosure of which is incorporated herein by reference in its entirety.

BACKGROUND OF THE INVENTION

1. Field of the Invention

The present invention relates to a printer capable of printing on both surfaces of a printing medium.

2. Description of the Related Art

Conventionally, there has been known a double-sided printer that includes a mechanism turning a printing medium such as a printing paper upside down and is capable of printing on one surface of the printing medium and thereafter printing on the other surface by turning the printing medium upside down. For example, as described in Japanese Patent Application Laid-open No. 2001-31309, there has been known a printer that prints on one surface (front surface) of a printing paper by a printing head, thereafter turns the printing paper upside down by a switchback mechanism, then feeds the printing paper to the printing head again, and prints on the other surface (rear surface) of the printing paper.

As described in Japanese Patent Application Laid-open No. 2001-31309, the conventional double-sided printer prints on the front surface of the printing medium by the printing head, immediately thereafter, turns the printing medium upside down by the switchback mechanism or the like, and feeds the printing medium to the printing head again to print on the rear surface. However, especially when the printing head is an inkjet head, if the printing medium is turned upside down immediately after the printing on the front surface of the printing medium, the printing medium is turned upside down in a state where ink on the front surface is not completely dried, which leads to a risk that the printing on the front surface gets dirty when it comes into contact with a roller or the like.

SUMMARY OF THE INVENTION

It is an object of the present invention to provide a printer which, after printing on a front surface of a printing medium, is capable of turning the printing medium upside down and printing on a rear surface after ink adhering to the front surface is surely dried.

According to a first aspect of the present invention, there is provided a printer which performs printing by jetting an ink onto a printing medium, the printer including:

an ink-jet head jetting the ink onto the printing medium;

a first rotatable body;

a first attaching mechanism attaching the printing medium to an outer peripheral surface of the first rotatable body;

a separating mechanism separating the printing medium attached to the outer peripheral surface of the first rotatable body from the first rotatable body;

a first rotational drive mechanism driving the first rotatable body and;

a control mechanism controlling the first attaching mechanism, the separating mechanism, and the first rotational drive mechanism, wherein a transporting route is formed in the printer through which the printing medium is transported, the transporting route including: a first route extending from a facing position facing the ink-jet head to a first position which is located on the outer peripheral surface and to which the printing medium having been subjected to the printing on a first surface is transferred; a second route formed on the outer peripheral surface and extending from the first position to a second position at which the printing medium is separated from the first rotatable body by the separating mechanism; a third route formed on the outer peripheral surface and extending from the second position to the first position; and a fourth route extending from the second position to the facing position; and when the printing medium is transported, the control mechanism controls the first attaching mechanism, the separating mechanism, and the first rotational drive mechanism such that the printing medium is transported through the first route in a state that the printed first surface is exposed, then the printing medium is transported through the second route and the third route at least once while being attached to the outer peripheral surface of the first rotatable body, then the printing medium is separated from the first rotatable body by the separating mechanism, and further the printing medium is transported through the fourth route to be transported toward the ink-jet head while a second surface opposite the first surface is exposed.

In the present invention, the printing medium having been subjected to the printing on the first surface by the ink-jet head passes through the first route to be transported to the first rotatable body. Further, the first sucking mechanism sucks the printing medium to the outer peripheral surface of the first rotatable body so that the printed first surface is exposed outward and the first rotatable body rotates in this state, so that the printing medium passes through the second route to be transported along a circumferential direction of the first rotatable body. Thereafter, the printing medium is turned upside down when separated from the first rotatable body by the separating mechanism to be sent to the fourth route and is sent to the ink-jet head by the transporting mechanism in the reversed state, and then the ink-jet head prints on the rear surface of the printing medium.

Here, in order to only turn the printing medium upside down, it is not necessary for the first rotatable body to which the printing medium is being sucked to make one rotation or more, but in the present invention, in order to promote the drying of the ink on the printed first surface, the first rotatable body to which the printing medium is being sucked is caused to make one rotation or more. That is, the printing medium having passed through the second route is not sent immediately to the fourth route but is made to pass through the third route first and then is sent to the fourth route. This makes it possible to turn the printing medium upside down and print on the second surface after the first surface of the printing medium is fully dried. Therefore, it is possible to prevent the first surface of the printing medium from being stained when the printing medium is turned upside down.

According to a second aspect of the present invention, there is provided a printer which performs a printing by jetting an ink onto an printing medium, the printer including:

an ink-jet head jetting the ink onto the printing medium;

a rotatable body which is rotatable;

a attaching mechanism attaching the printing medium to an outer peripheral surface of the rotatable body;

a rotational drive mechanism driving the rotatable body;

a separating mechanism separating the printing medium attached to the outer peripheral surface of the rotatable body from the first rotatable body; and a control mechanism controlling the attaching mechanism, the separating mechanism, and the rotary-driving mechanism, wherein a transporting route is formed in the printer through which the printing medium is transported, the transporting route including: a first route extending from a facing position facing the ink-jet head to a first position which is located on the outer peripheral surface and to which the printing medium having been subjected to the printing on a first surface is transferred; a second transporting route formed on the outer peripheral surface and extending from the first position to a second position at which the printing medium is separated from the first rotatable body by the separating mechanism; and a third transporting route extending from the second position to the facing position;

when the printing paper is transported, the control mechanism controls the attaching mechanism, the separating mechanism, and the rotary-driving mechanism such that the printing medium is transported through the first route in a state that the printed first surface is exposed, then the printing medium is separated from the rotatable body by the separating mechanism after the printing medium is kept attached on the outer peripheral surface for a predetermined time, and then the printing medium is transported through the third transporting route to be transported toward the ink-jet head while a second surface opposite the first surface is exposed; and the control mechanism further determines the predetermined time based on a printing duty of the first surface of the printing medium or an environmental condition in the printer.

According to the present invention, since it is possible to turn the printing paper upside down and print on the second surface after the first surface of the printing medium is fully dried, it is possible to prevent the first surface of the printing medium from being stained at the time when it is turned upside down. Note that the environmental condition in the printer refers to temperature or humidity in the printer, or when a fan or the like is disposed in the printer to generate a wind inside, the environmental condition refers to velocity of the wind or the like.

DETAILED DESCRIPTION OF THE PREFERRED EMBODIMENTS

First Embodiment

Figure 1:
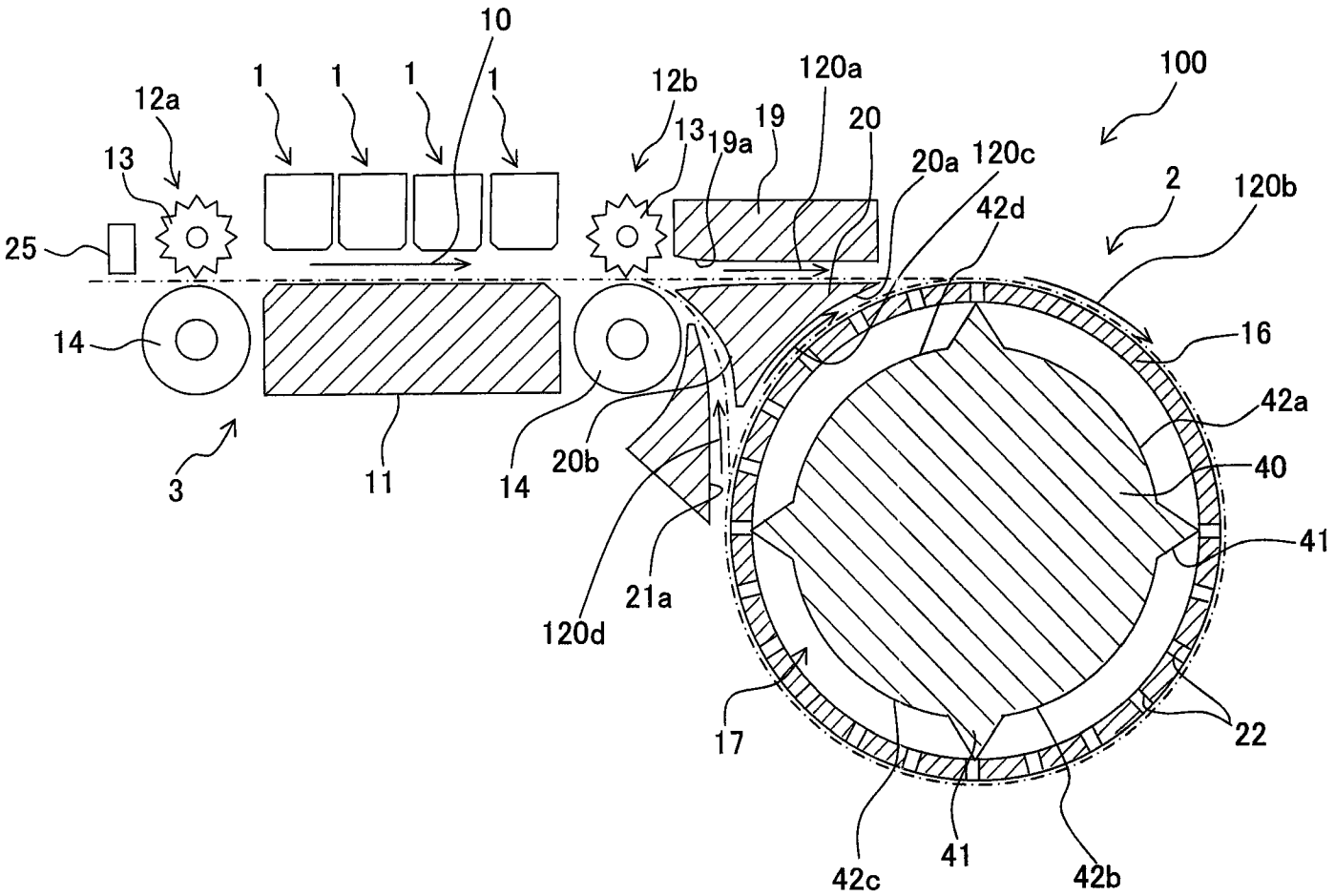
FIG. 1 is a schematic view showing the structure of a printer according to a first embodiment.
Figure 2:
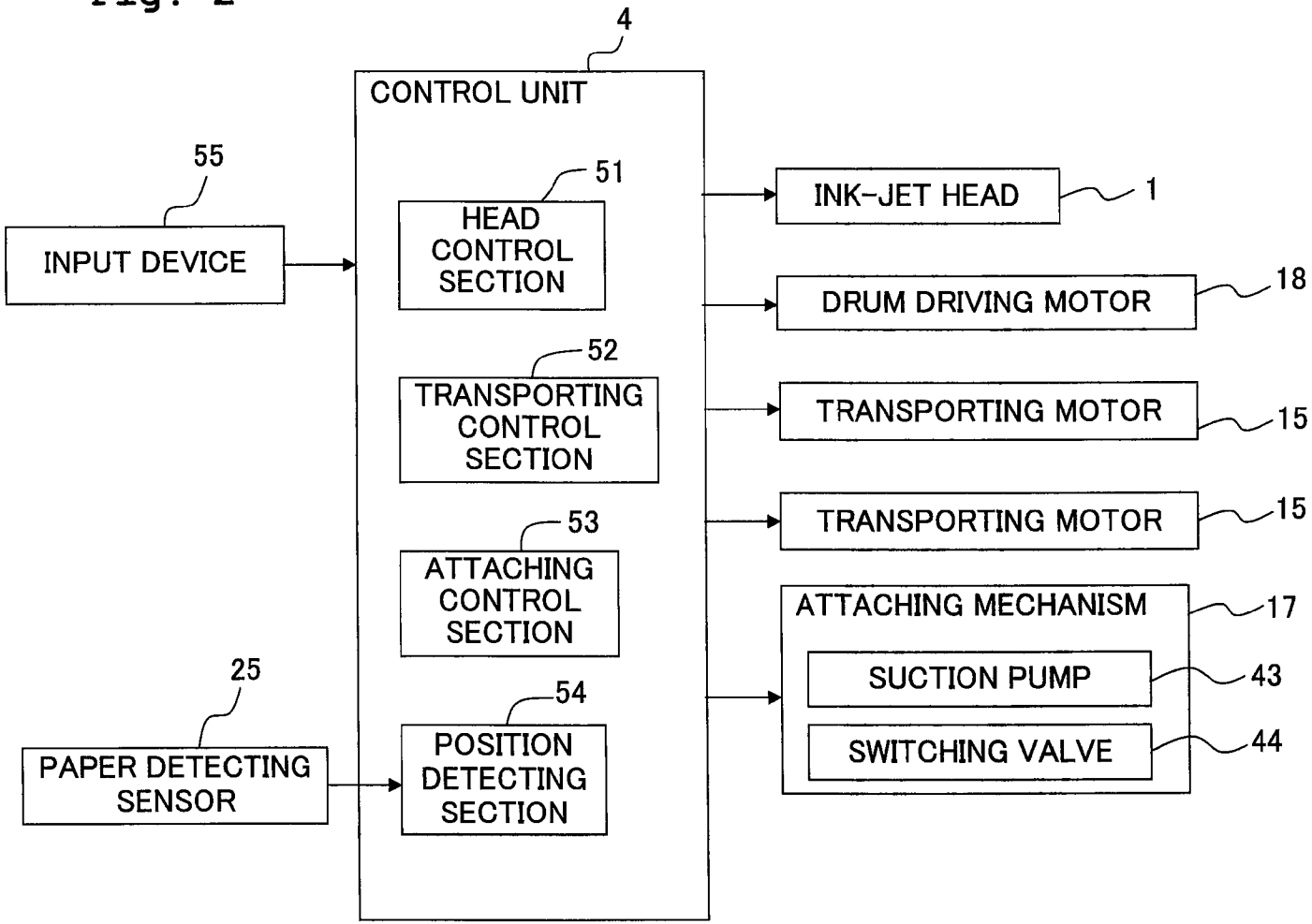
FIG. 2 is a block diagram schematically showing the electrical configuration of the printer according to the first embodiment.

Next, embodiments of the present invention will be described. As shown in FIGS. 1 and 2, the printer 100 of the first embodiment includes: four ink-jet heads 1 jetting ink to a printing paper P (printing medium) to print thereon; a reversing mechanism 2 turning the printing paper P upside down; a transporting mechanism 3 transporting the printing paper P between the ink-jet heads 1 and the reversing mechanism 2; a control unit 4 controlling the whole printer 100; and so on.

The printer 100 is capable of printing characters, images, and so forth on both surfaces of the printing paper P. In FIG. 1, a transporting route 10 through which the printing paper P is transported during a period from the front surface printing to the rear surface printing is shown by a two-dot chain line. After printing on one surface (front surface) of the printing paper P by the ink-jet heads 1, the printer 100 sends the printing paper P to the reversing mechanism 2 by the transporting mechanism 3 and turns the printing paper P upside down by the reversing mechanism 2. Thereafter, the printer 100 sends the reversed printing paper P by the reversing mechanism 2 again to the ink-jet heads 1 by the transporting mechanism 3, and prints on the other surface (rear surface) of the printing paper P by the ink-jet heads 1. Concrete structures of the printer 100 realizing the above operation will be described in detail in sequence.

The four ink-jet heads 1 are arranged in line in a horizontal direction, each facing a platen 11. The four ink-jet heads 1 jet four color inks (yellow, magenta, cyan, black) respectively to the printing paper P which is transported through the route between the inkjet heads 1 and the platen 11 to print characters, images, and so forth on the printing paper P. It should be noted that the ink-jet head 1 is not limited to one having a specific structure. For example, the ink-jet head 1 may be a line-type head which has a large number of nozzles arranged substantially all along a width direction of the printing paper P (direction vertical to the paper in FIG. 1) and performs printing by jetting ink from the nozzles while being fixedly positioned. Alternatively, the ink-jet head 1 may be a serial-type head which performs printing by jetting ink from a nozzle while reciprocating in the width direction of the printing paper P.

The transporting mechanism 3 has two roller pairs 12*a*, 12*b* disposed on horizontal-direction both sides of the ink-jet heads 1 and the platen 11. Each of the roller pairs 12*a*, 12*b* includes: a first transporting roller 13 having a plurality of projections arranged in a circumferential direction thereof; a second transporting roller 14 in a cylindrical shape facing the first transporting roller 13 across the transporting route 10 of the printing paper P; and a transporting motor 15 (see FIG. 2) rotary-driving the second transporting roller 14. In each of the roller pairs 12*a*, 12*b*, the second transporting roller 14 is rotary-driven by the transporting motor 15, so that the printing paper P is nipped by the first transporting roller 13 and the second transporting roller 14 to be transported in the horizontal direction.

The first transporting rollers 13 having the projections are disposed on the ink-jet head 1 side (upper side in FIG. 1) of the transporting route 10 of the printing paper P. That is, out of the first transporting rollers 13 and the second transporting rollers 14, the first transporting rollers 13 whose contact areas with the printing paper P are smaller come into contact with a printed surface of the printing paper P. Therefore, it is possible to transport the printing paper P while preventing as much as possible the printed surface from being stained. At a position on a further left side (side opposite the ink-jet heads 1) of the roller pair 12*a* located on the left side in FIG. 1, there is provided a paper detecting sensor 25 detecting the printing paper P which is to be fed to the ink-jet heads 1.

Next, the reversing mechanism 2 will be described in detail. The reversing mechanism 2 includes: a cylindrical drum 16 rotatably structured; a sucking mechanism 17 (first sucking mechanism; first attaching mechanism) sucking the printing paper P transported by the transporting mechanism 3 onto an outer peripheral surface of the drum 16; a drum driving motor 18 (see FIG. 2) rotary-driving the drum 16; paper guides 19, 20, 21 guiding the printing paper P between the roller pair 12*b* of the transporting mechanism 3 and the drum 16; and so on.

The drum 16 is disposed so that its tangent (tangent plane) is flush with an upper surface of the platen 11, and the printing paper P is transported between the ink-jet heads 1 and the drum 16 by the transporting mechanism 3 along the tangent of the drum 16. Further, the drum 16 has a large number of through holes 22 arranged in its circumferential direction. Via these through holes 22, an inner space of the drum 16 communicates with the atmosphere. The sucking mechanism 17 (to be described later) is provided in the inner space of the drum 16. When the drum 16 rotates with the printing paper P being sucked on its outer peripheral surface by the sucking mechanism 17, the printing paper P is transported in the circumferential direction of the drum 16.

The sucking mechanism 17 includes, on an inner side of the drum 16, a columnar fixed body 40 disposed at a spaced interval from an inner surface of the drum 16. The fixed body 40 is immovably fixed to a frame, not shown, of the printer 100 and the drum 16 located on an outer side of the fixed body 40 rotates relative to the fixed body 40.

On an outer peripheral surface of the fixed body 40, four partitioning walls 41 are arranged at equal intervals (90° angular intervals) in the circumferential direction. The inner surface of the drum 16 is slidably in contact with tips of the partitioning walls 41. The four partitioning walls 41 divide a space between the drum 16 and the fixed body 40 into four in the circumferential direction, so that four decompression chambers 42 (42*a* to 42*d*) each in a ¼ arc shape are formed. Note that, though FIG. 1 shows an example where the four partitioning walls 41 and the fixed body 40 are integrally formed, separate members from the fixed body 40 may be formed as the partitioning walls 41 to be fixed to the outer peripheral surface of the fixed body 40.

The four decompression chambers 42 are connected to a suction pump 43 (see FIG. 2) as a suction source. Further, between the four decompression chambers 42 and the suction pump 43, there are provided four switching valves 44 (for example, solenoid valves or the like) independently switching a communication state and a shut-off state between the decompression chambers 42 and the suction pump 43. By independently switching the communication/shut-off between the four decompression chambers 42 and the suction pump 43 by the four switching valves 44, it is possible for the suction pump 43 to reduce the pressures of the four decompression chambers 42 independently.

As previously mentioned, the through holes 22 arranged at intervals in the circumferential direction are formed in the drum 16 as shown in FIG. 1. Further, in the drum 16, in each area (¼ arc area) sandwiched by its two points in contact with the two partitioning walls 41 respectively, two or more of the through holes 22 are arranged in the circumferential direction. That is, the through holes 22 communicate with the single decompression chamber 42 demarcated by the two partitioning walls 41. With this structure, when the suction pump 43 reduces the pressure of any one of the decompression chambers 42 while the printing paper P is on the outer peripheral surface of the drum 16, the printing paper P is sucked via the through holes 22 communicating with this decompression chamber 42. Owing to such communication of the through holes 22 with the single decompression chamber 42, only by pressure-reducing the signal decompression chamber 42, it is possible to suck the printing paper P simultaneously via the through holes 22 and surely hold the printing paper P. This is also advantageous in that the structure can be simple compared with that in a case where the decompression chambers 42 and the through holes 22 are provided in one-to-one correspondence and a large number of the through holes 22 are independently controlled.

Then, the printing paper P subjected to the printing on the front surface, when transported from the ink-jet heads 1 to the drum 16 by the transporting mechanism 3, is sucked to the outer peripheral surface of the drum 16 by the sucking mechanism 17, with the printed front surface facing outward. When the drum 16 is rotated by the drum driving motor 18 in a clockwise direction in FIG. 1 while the printing paper P is thus sucked and fastened to the outer peripheral surface of the drum 16, the printing paper P is transported along the circumferential direction of the drum 16.

Further, it is possible to select on which area of the outer peripheral surface of the drum 16 the printing paper P is to be sucked by independently switching the pressure-reduced states of the four decompression chambers 42. More concretely, by switching the pressure-reduced state of the decompression chamber 42*d* closest to the roller pair 12*b* among the four decompression chambers 42*a* to 42*d*, it is possible to select whether the printing paper P moving in the circumferential direction in accordance with the rotation of the drum 16 is to be kept sucked on the outer peripheral area of the drum 16 corresponding to the decompression chamber 42*d* or is to be separated (released) from the drum 16.

Next, the paper guides 19, 20, 21 will be described. Among the three paper guides 19 to 21, the two paper guides 19, 20 are disposed between the roller pair 12*b* of the transporting mechanism 3 and the drum 16 so as to face each other across the tangent of the drum 16. When the printing paper P having been subjected to the printing on the front surface by the inkjet heads is transported thereto by the transporting mechanism 3, the two paper guides 19, 20 guide the printing paper P to the drum 16 along the tangent of the drum 16.

Further, the paper guide 20 has two curved guide surfaces 20*a*, 20*b*. The guide surface 20*a* faces the outer peripheral surface of the drum 16. The other guide surface 20*b* faces the other paper guide 21 (its guide surface 21*a*) located under the paper guide 20. When the printing paper P sucked to the drum 16 moves in the circumferential direction of the drum 16 in accordance with the rotation of the drum 16 and its leading end reaches a lower end position of the paper guide 20, the paper guide 20 guides the printing paper P to one of two routes, that is, a route where the printing paper P moves in the circumferential direction while kept sucked to the outer peripheral surface of the drum 16 and a route where the printing paper P is separated (released) from the outer peripheral surface of the drum 16 to move to the roller pair 12*b*.

That is, when the printing paper P reaches the position of the paper guide 20, and when the decompression chamber 42 is in the pressure-reduced state and the printing paper P is in a state of being sucked to the outer peripheral surface of the drum 16 on the area corresponding to the decompression chamber 42*d*, the printing paper P is guided by the guide surface 20*a* of the paper guide 20 to continue to move along the outer peripheral surface of the drum 16. On the other hand, when the pressure-reduced state of the decompression chamber 42*d* is cancelled and thus the leading end portion of the printing paper P separates from the outer peripheral surface of the drum 16 on the area corresponding to the decompression chamber 42*d*, the printing paper P is peeled off from the drum 16 by the lower end portion of the paper guide 20 to be guided to the roller pair 12*b* by the guide surface 20*b* and the guide surface 21*a*, of the paper guide 21, facing the guide surface 20*b*. Incidentally, as shown in FIG. 1, when the printing paper P separates from the outer peripheral surface of the drum 16 to be guided to the roller pair 12*b*, the printing paper P is turned upside down so that the printed surface (front surface) which has been on the outer side on the drum 16 faces downward and the surface not printed (rear surface) faces upward.

That is, by switching the pressure-reduced state of the decompression chamber 42*d*, it is possible to select whether the printing paper P at the position of the paper guide 20 is to be kept moving in the circumferential direction of the drum 16 or is to be separated from the outer peripheral surface of the drum 16, turned upside down, and transported to the ink-jet heads 1.

In other words, the printing paper P having passed through the transporting route 10 passes through a feeding route (first route 120*a*) demarcated by a guide surface 20*c* of the paper guide 20 and a guide surface 19*a* of the paper guide 19 to be transported to the drum 16. The printing paper P transported to the drum 16 passes through a second route 120*b* corresponding to an area, of the front surface of the drum 16, not facing the paper guides 20, 21 and a third route 120*c* corresponding to an area thereof facing the paper guides 20, 21. Consequently, the ink on the printing paper P is dried. Thereafter, the printing paper P having passed through the second route 120*b* is not sent to the third route 120*c* but is sent to a return route (fourth route 120*d*) demarcated by the guide surface 21*a* of the paper guide 21 and the guide surface 20*b* of the paper guide 20. In this manner, when the ink on the printing paper P is dried, the printing paper P is made to pass through not only the second route 120*b* but also the third route 120*c*.

As shown in FIG. 1, the outer peripheral surface of the drum 16 has a partial area 50 where no through hole 22 is formed, and a circumferential-direction length of the partial area 50 is equal to or larger than a length, in terms of the circumferential direction of the drum 16, corresponding to the one decompression chamber 42 (in FIG. 1, an arc area with a 90° center angle). This structure is adopted in order to prevent a force sucking the leading end portion of the printing paper P from decreasing when the leading end portion of the printing paper P transported to the drum 16 by the transporting mechanism 3 is sucked to the drum 16, due to the structure in which the through hole 22 closed by the leading end portion and the other through holes 22 in an open state communicate with the same decompression chamber 42. This will be described in detail later.

Next, the electrical configuration of the printer 100 will be described with reference to FIG. 2, focusing on the control unit 4. The control unit 4 shown in FIG. 2 includes, for example, a Central Processing Unit (CPU), a Read Only Memory (ROM) in which various kinds of programs, data, and the like for controlling the whole operation of the printer 100 are stored, a Random Access Memory (RAM) temporarily storing data processed by the CPU and may be a device executing various controls described below as software when the CPU executes the programs stored in the ROM. Alternatively, the control unit 4 may be a device realized by hardware formed by the combination of various kinds of circuits including an arithmetic circuit.

The control unit 4 (printing control mechanism) includes a head control section 41, a transporting control section 52, a suction control section 53 (an attaching control section), and a position detecting section 54. The head control section 51 controls the inkjet heads 1 based on printing data input from an input device 55 such as a PC so that the inkjet heads 1 jet the inks toward the printing paper P to print a desired image and so forth on the printing paper P. Further, the head control section 51 calculates a printing duty per one sheet of printing paper P (that is, a total amount of the inks jetted from the ink-jet heads 1 to one sheet of the printing paper P) based on the printing data input from the input device 55.

The transporting control section 52 controls the two transporting motors 15 of the transporting mechanism 3, the drum driving motor 18 rotary-driving the drum 16, and so on so that the printing paper P is transported at the time of the double-sided printing. Concrete paper transporting control executed by the transporting control section 52 will be described in detail later.

The suction control section 53 controls the suction pump 43 and the switching valves 44 of the sucking mechanism 17 so that the sucking mechanism 17 sucks the printing paper P to the drum 16 and separates (releases) the printing paper P from the drum 16. In the first embodiment, the suction control section 53, which controls the sucking mechanism 17 so that the sucking mechanism 17 performs the suction/separation of the printing paper P, and the paper guide 20, which guides the separated printing paper P to the roller pair 12*b* of the transporting mechanism 3 while turning the printing paper P upside down, correspond to a separating mechanism of the invention of the present application which turns the printing paper P upside down while separating it from the outer peripheral surface of the drum 16.

The position detecting section 54 detects a leading end position of the printing paper P transported by the transporting mechanism 3, based on a feeding timing of the printing paper P detected by the paper detecting sensor 25 and information regarding the number of rotations of the transporting rollers 14. Such detection of the leading end position of the printing paper P is essential for the printing by the ink-jet heads 1, but in this embodiment, the detection result of the position detecting section 54 is also used for the following purpose besides the printing purpose.

Figure 3A:
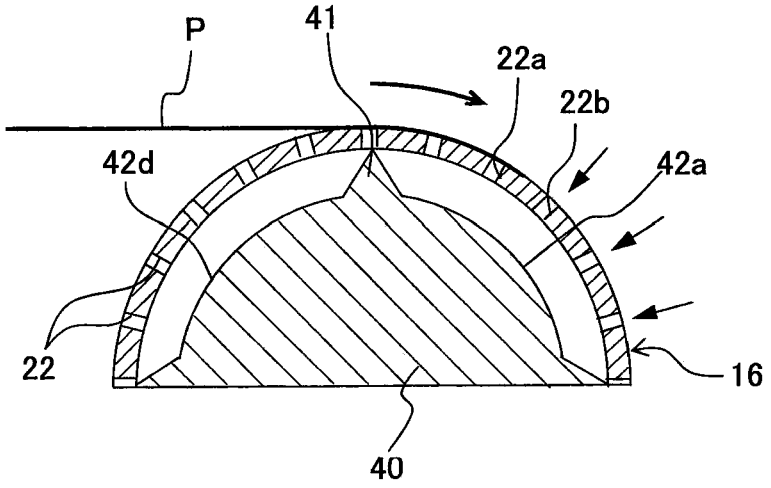
FIG. 3A is an enlarged view of an outer peripheral portion of a drum having through holes in a whole periphery thereof.
Figure 3B:
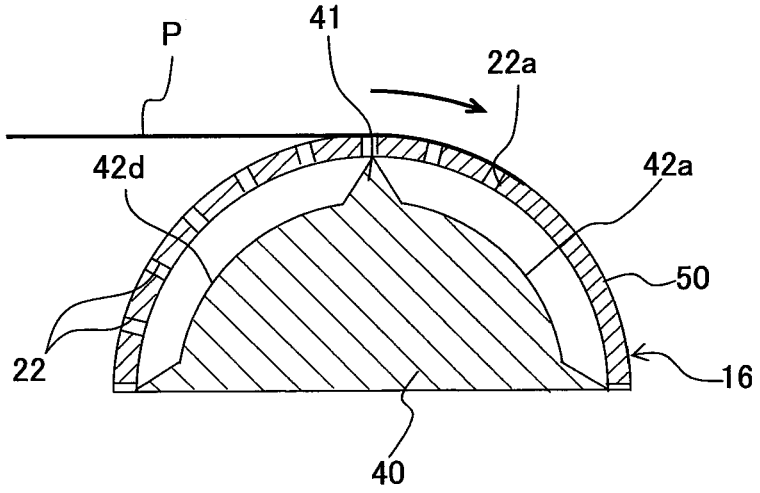
FIG. 3B is an enlarged view of an outer peripheral portion of a drum having no through hole in a partial area of the outer peripheral surface thereof.

FIGS. 3A and 3B are partial enlarged views of outer peripheral portions of drums 16. As previously described, not less than two through holes 22 communicate with the single decompression chamber 42. When the leading end portion of the printing paper P is sucked via some through hole 22 (22*a*) to close the through hole 22*a*, if another through hole 22*b* which is not closed by the printing paper P and thus is in an open state exists adjacently to the closed through hole 22*a* in terms of a rotation direction (arrow direction) of the drum 16 as shown in FIG. 3A, the through hole 22*a* closed by the printing paper P and the through hole 22*b* in the open state can take a state where they communicate with the same decompression chamber 24*a*. At this time, even with an effort to pressure-reduce the decompression chamber 42*a*, the decompression chamber 42*a* is not easily pressure-reduced since the atmosphere flows into the decompression chamber 42*a* from the through hole 22*b* in the open state, resulting in a decrease in a force sucking the leading end portion of the printing paper P.

Therefore, in this embodiment, in order to solve the above problem, first, as shown in FIG. 1, the partial area 50 without any through hole 22 is provided on the outer peripheral surface of the drum 16. The circumferential-direction length of the partial area 50 is set equal to or larger than the length, in terms of the circumferential direction of the drum 16, corresponding to the single decompression chamber 42 (arc area with a 90° center angle), as shown in FIG. 1. In addition, as shown in FIG. 3B, the drum driving motor 18 is controlled based on the leading end position of the printing paper P detected by the position detecting section 54 so that the leading end portion of the printing paper P is sucked by the through hole 22*a* which is closest to the partial area 50 in terms of a direction opposite the rotation direction of the drum 16. This can prevent the through hole 22*a* closed by the leading end portion of the printing paper P and the other through hole 22 in the open state from communicating with the same decompression chamber 42 and accordingly can prevent a decrease in the force sucking the leading end portion of the printing paper P.

Next, a series of operations (especially, a paper transporting operation) of the printer 100 at the time of the double-sided printing on the printing paper P will be described with reference to FIGS. 4 to 8.

Figure 4:
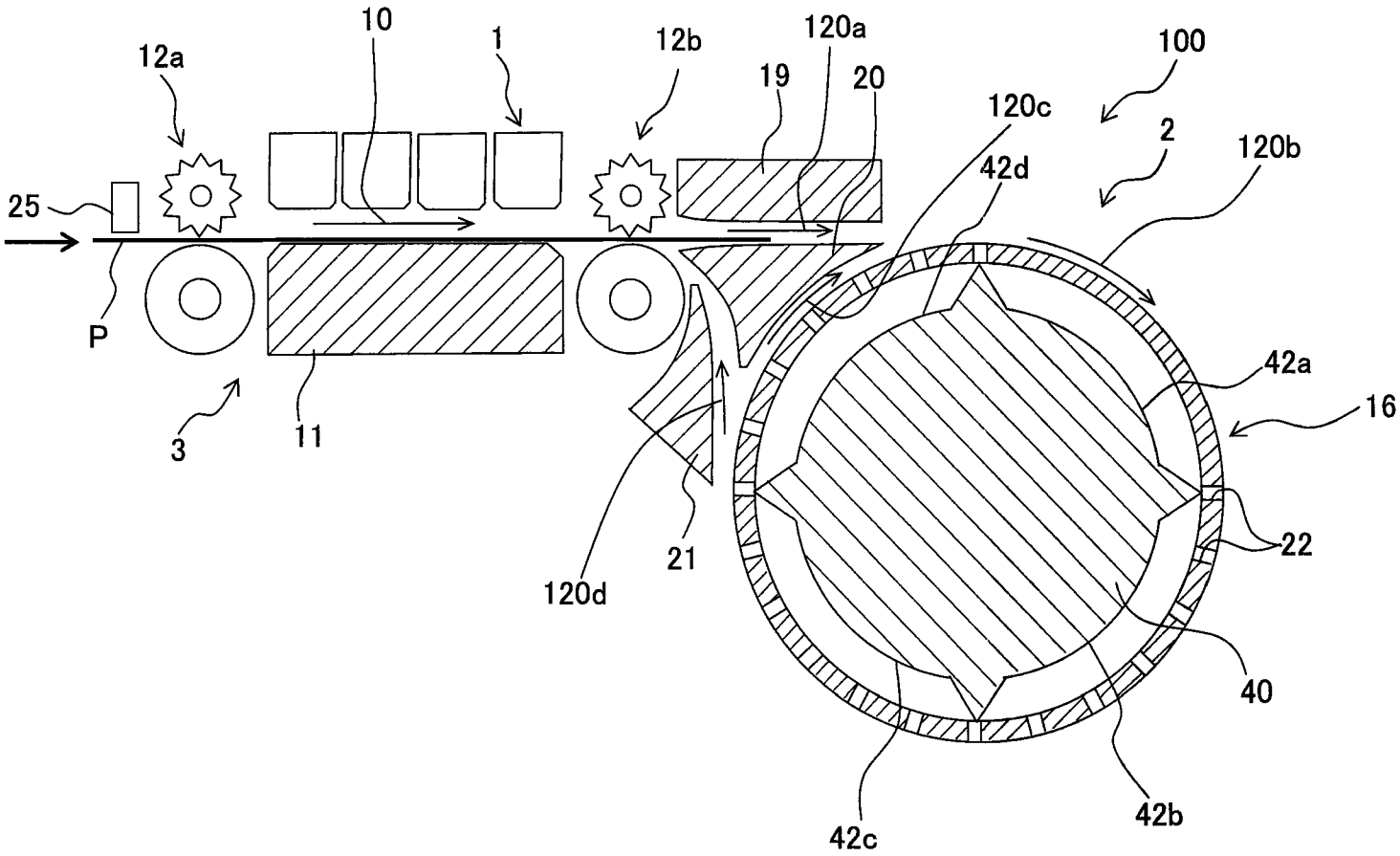
FIG. 4 is a view showing the operation (front surface printing) of the printer at the time of the double-sided printing.

As shown in FIG. 4, when the paper detecting sensor 25 detects that the printing paper P is fed from a paper feeder (not shown), the printing paper P is transported in an arrow direction (rightward in FIG. 4) by the two roller pairs 12*a*, 12*b* of the transporting mechanism 3. At this time, the ink-jet heads 1 facing the platen 11 jet the inks to the printing paper P which is transported, to print on one surface (front surface) of the printing paper P.

Figure 5:
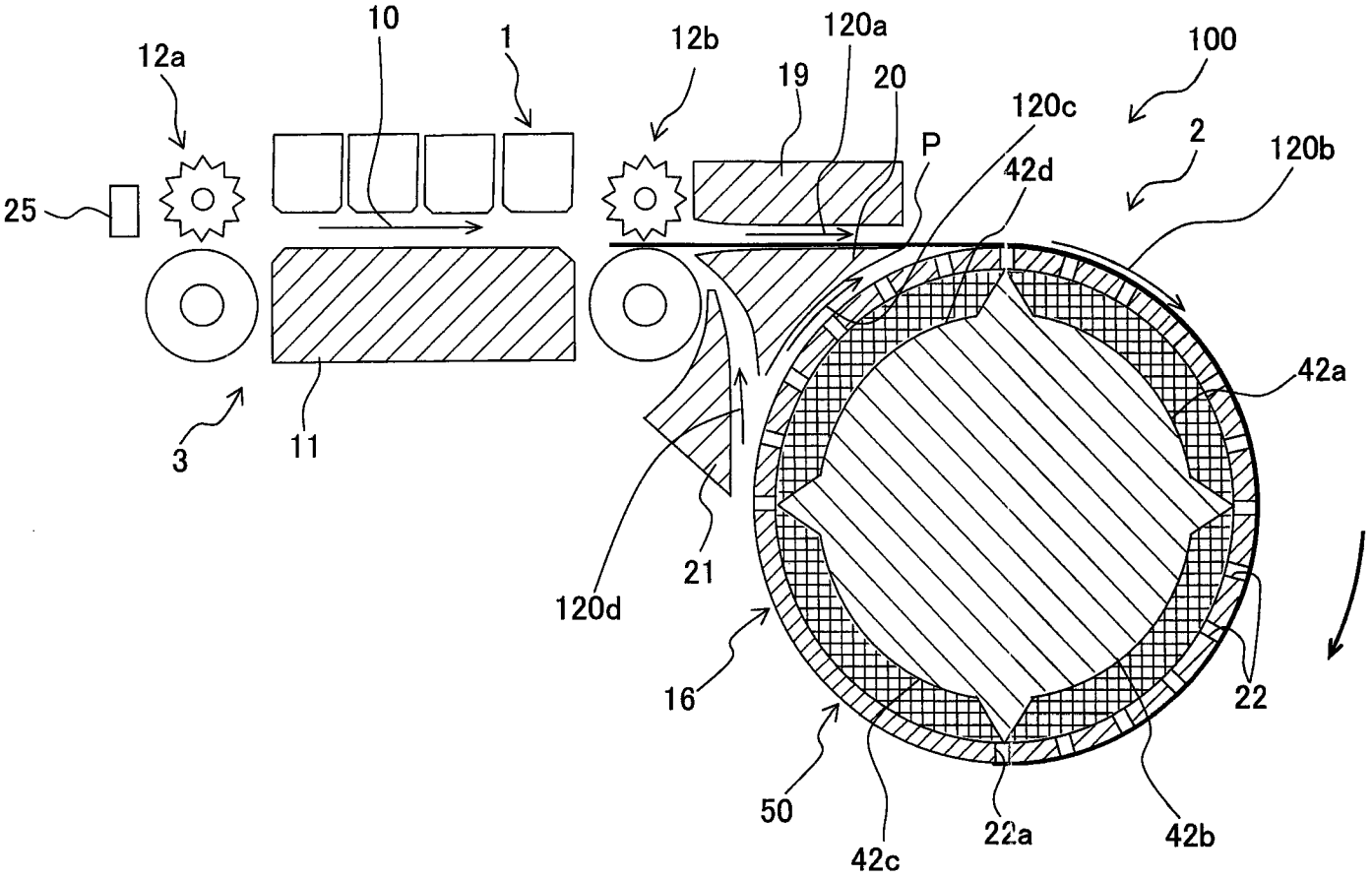
FIG. 5 is a view showing the operation (suction by the drum) of the printer at the time of the double-sided printing.

Thereafter, as shown in FIG. 5, the printing paper P having been subjected to the printing on the front surface passes through the transporting route 10 to be transported rightward by the transporting mechanism 3 and passes through the first route 120*a* sandwiched by the two paper guides 19, 20 to be guided to an upper end position of the drum 16. At this time, the suction control section 53 controls the sucking mechanism 17 to reduce the pressures of the four decompression chambers 42*a* to 42*d*, so that the printing paper P is sucked to the outer peripheral surface of the drum 16 with its printed front surface facing outward. Note that each hatched portion in FIG. 5 is the decompression chamber 42 in the pressure-reduced state (this is the same in the description below).

At the time of the suction of the leading end portion of the printing paper P, the transporting control section 52 controls the rotation of the drum 16 (rotary-driving by the drum driving motor 18) based on the leading end position of the printing paper P detected by the position detecting section 54 so that the leading end portion of the printing paper P is sucked to the through hole 22*a* closest, in terms of the direction opposite the rotation direction, to the area 50 of the drum 16 without any through hole 22.

Further, the transporting control section 52 controls the drum driving motor 18 so that the drum 16 rotates clockwise while the printing paper P is sucked to the outer peripheral surface of the drum 16, to convey the printing paper P along the circumferential direction of the drum 16.

Figure 6:
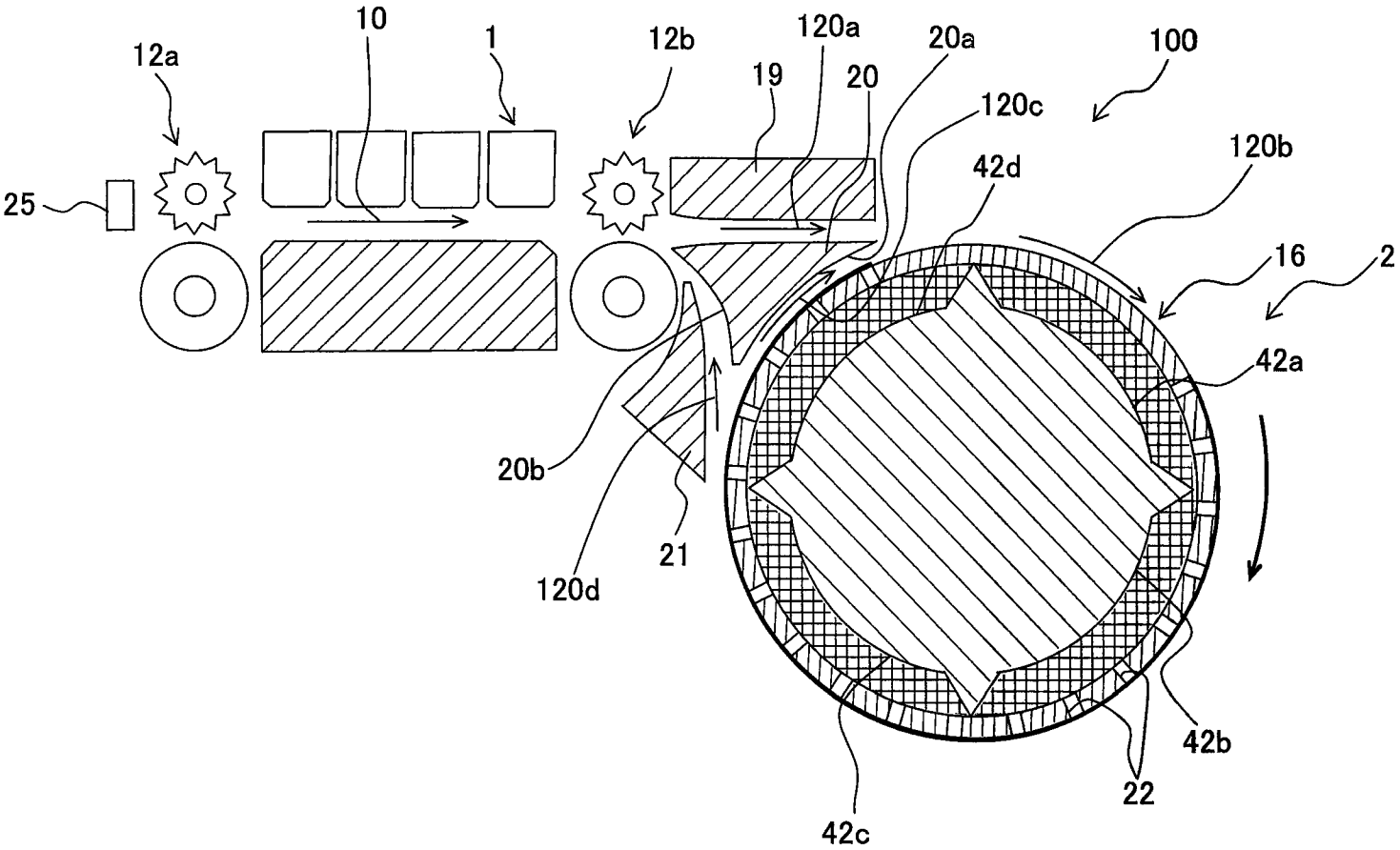
FIG. 6 is a view showing the operation (front surface drying) of the printer at the time of the double-sided printing.

Incidentally, as previously described, when the leading end portion of the printing paper P reaches the position of the paper guide 20 (when the drum 16 makes a ¾ clockwise rotation after the printing paper P is sucked), it is possible to select whether to keep the printing paper P sucked on the outer peripheral surface of the drum 16, depending on whether the pressure-reduced state of the decompression chamber 42*d* is kept or cancelled by the sucking mechanism 17. Here, in order to sufficiently dry the ink on the front surface of the printing paper P, the pressure-reduced state of the decompression chamber 42*d* is not cancelled but the printing paper P is kept sucked on the drum 16 as shown in FIG. 6, and the drum 16 is caused to further make one rotation or more in the clockwise direction. In other words, the printing paper P having passed through the second route 120*b* is not sent to the fourth route 120*d* but is sent to the third route 120*c*.

That is, if the purpose is only to turn the printing paper P upside down, it is only necessary for the drum 16 to make a ¾ rotation, but in this embodiment, the drum 16 is intentionally caused to make one rotation or more (at least one rotation), whereby the printing paper P is kept sucked on the outer peripheral surface of the drum 16 and the period of time from the completion of the front surface printing up to the reversing is reserved, and during this period of time, the front surface of the printing paper P is sufficiently dried. Further, in order to reserve the drying time, it is also possible to stop the rotation of the drum 16 and make the printing paper P on standby while keeping it sucked on the drum 16, but here, by causing the drum 16 to make one rotation or more before the reversing, it is possible to forcibly dry the front surface of the printing paper P by the air flow generated on the outer peripheral surface of the drum 16 when the drum 16 rotates, which further promotes the drying of the ink on the front surface.

Figure 7:
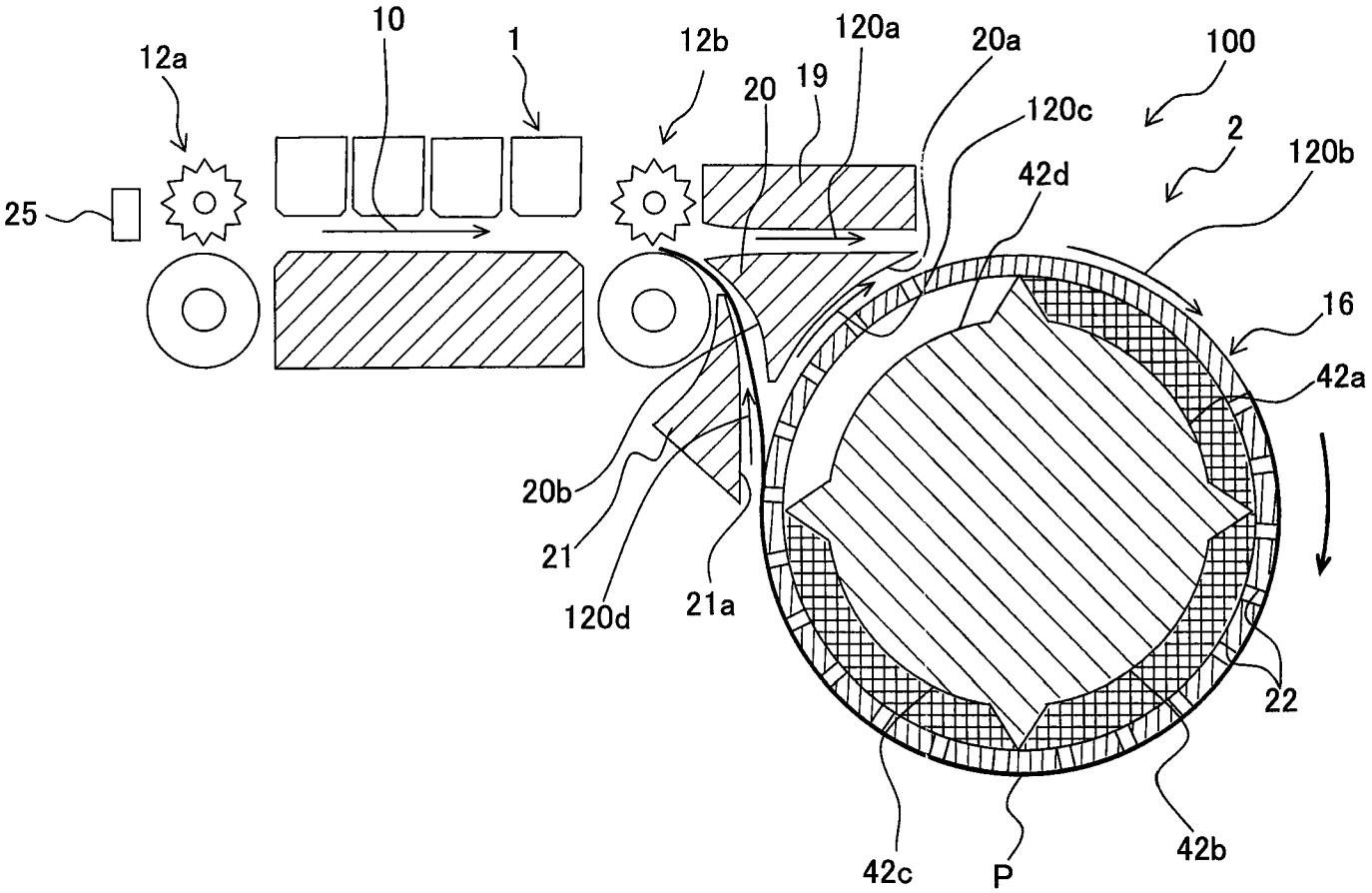
FIG. 7 is a view showing the operation (reversing) of the printer at the time of the double-sided printing.

Then, when the total number of rotations of the drum 16 after the leading end portion of the printing paper P is sucked to the outer peripheral surface of the drum 16 reaches a predetermined number or more, the suction control section 52 causes the sucking mechanism 17 to cancel the pressure-reduced state of the decompression chamber 42*d* as shown in FIG. 7. Consequently, the leading end portion of the printing paper P separates from the outer peripheral surface of the drum 16 to be peeled off from the drum 16 by the lower end portion of the paper guide 20. Thereafter, in accordance with the rotation of the drum 16, the printing paper P is guided to the roller pair 12*b* by the two paper guides 20, 21. That is, the printing paper P having passed through the second route 120*b* is not sent to the third route 120*c* but is sent to the fourth route 120*d*.

Here, the higher the printing duty for the front surface printing (the larger an amount of the inks jetted to the front surface of the printing paper P from the ink-jet heads 1), the longer it takes to completely dry the ink adhering to the front surface. That is, easiness of the drying depends on the printing duty. Therefore, the transporting control section 52 preferably decides (changes) the total number of rotations that the drum 16 makes during a period from the suction of the printing paper P onto the drum 16 up to the separation of the printing paper P therefrom, based on the printing duty for the front surface printing calculated by the head control section 51.

For example, when the printing duty is low as in a case of the text printing, the ink quickly dries and therefore it is determined that the additional rotation of the drum 16 is not required and the total number of rotations of the drum 16 is set to ¾ rotation (only the rotation necessary for the reversing). Further, when the printing duty is on a middle level as in a case where text printing and image printing are mixed, the total number of rotations of the drum 16 is set to ¾ rotation+one rotation (the number of rotations is increased by one rotation). Further, when the printing duty is very high as in a case of whole surface image printing (solid printing), the total number of rotations of the drum 16 is set to ¾ rotation+two rotations (the number of rotations is increased by two rotations).

Figure 8:
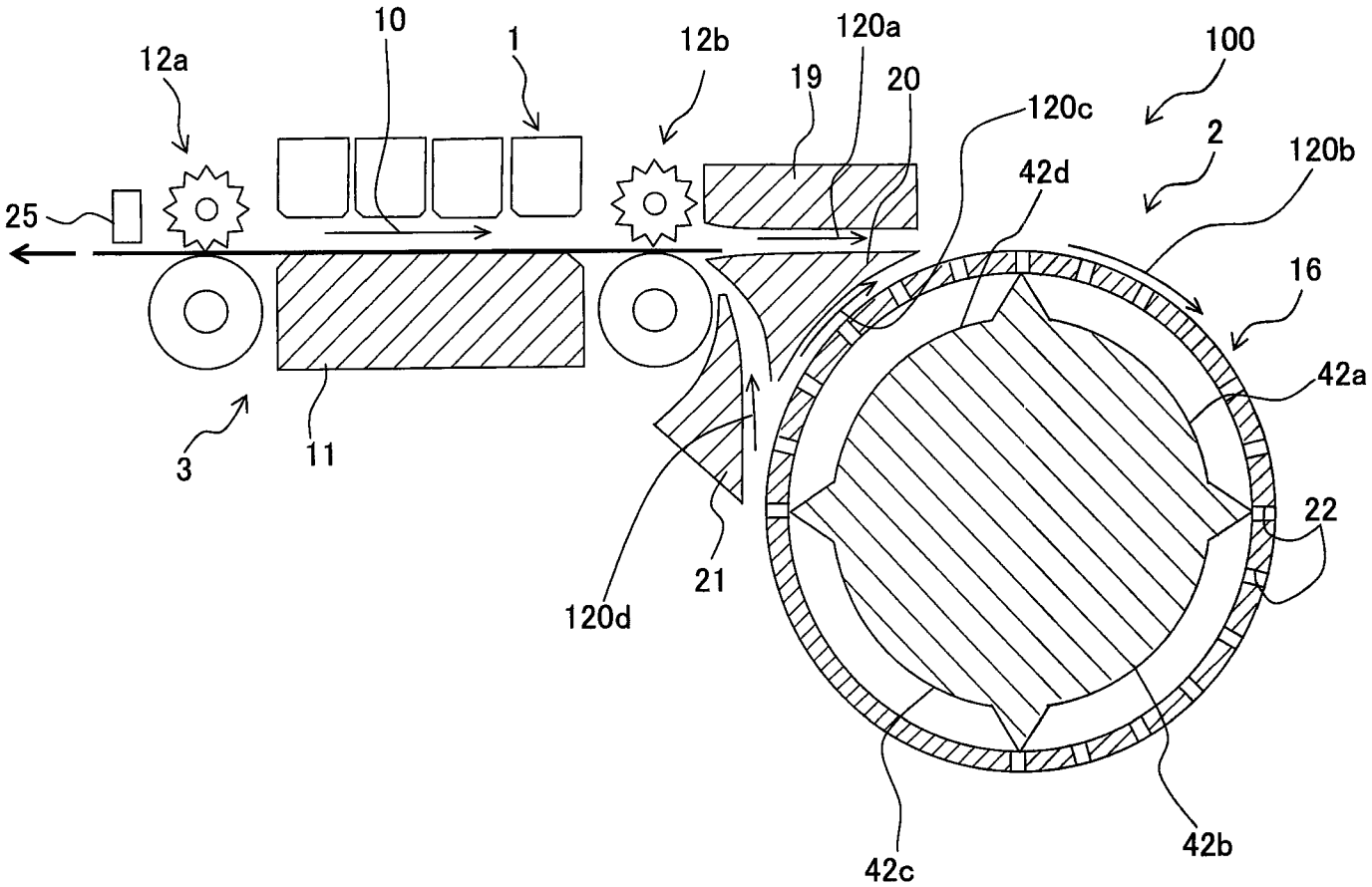
FIG. 8 is a view showing the operation (rear surface printing) of the printer at the time of the double-sided printing.

Thereafter, as shown in FIG. 8, when the printing paper P is delivered to the transporting mechanism 3 (roller pair 12*b*) from the drum 16 via the paper guides 20, 21, the transporting mechanism 3 transports the printing paper P in an arrow direction (leftward in FIG. 8). Here, since the printing paper P is turned upside down when separating from the drum 16, the printed front surface of the printing paper P faces downward and the unprinted rear surface faces upward to face the ink-jet heads 1. Therefore, by jetting the inks to the printing paper P, the ink-jet heads 1 print on the rear surface of the printing paper P.

As described hitherto, in the printer 100 of the first embodiment, the drum 16 makes one rotation or more (a larger number of rotations than the number of rotations necessary for the reversing) while the printing paper P is sucked to the outer peripheral surface of the drum 16 by the sucking mechanism 17, and thereafter, the printing paper P is separated from the drum 16. Therefore, it is possible to turn the printing paper P upside down and print on the rear surface after the front surface of the printing paper P is fully dried, which makes it possible to prevent the front surface of the printing paper P from being stained when it is reversed.

Incidentally, in the above-described first embodiment, the ink-jet heads 1 are disposed between the roller pairs 12*a*, 12*b*, but the ink-jet heads 1 may be disposed between the roller pair 12*b* and the drum 16. In this case, the printing paper P is first transported to the ink-jet heads 1 by the roller pairs 12*a*, 12*b* and the ink-jet heads 1 print on the front surface of the printing paper P. Thereafter, the printing paper P is sucked to the drum 16 and the drum 16 rotates, so that the printing paper P is transported in the circumferential direction of the drum 16 and the ink adhering on the front surface is dried.

Thereafter, when the drum 16 makes a predetermined number of rotations and the drying of the front surface is completed, the printing paper P is sent to the roller pairs 12*a*, 12*b* via the paper guides 20, 21 while turned upside down. Then, the transporting direction of the printing paper P is changed by the roller pairs 12*a*, 12*b* and the printing paper P is sent to the ink-jet heads 1 again, and the ink-jet heads 1 print on the rear surface.

Second Embodiment

Next, a second embodiment of the present invention will be described. The second embodiment is different in structure of the transporting mechanism from the first embodiment, and double-sided printing is performed while a printing paper P is transported by using two drums, namely, a drum facing ink-jet heads and a drum for the reversing. Components having substantially the same structures as those of the first embodiment will be denoted by the same reference numerals and symbols, and description thereof will be omitted.

Figure 9:
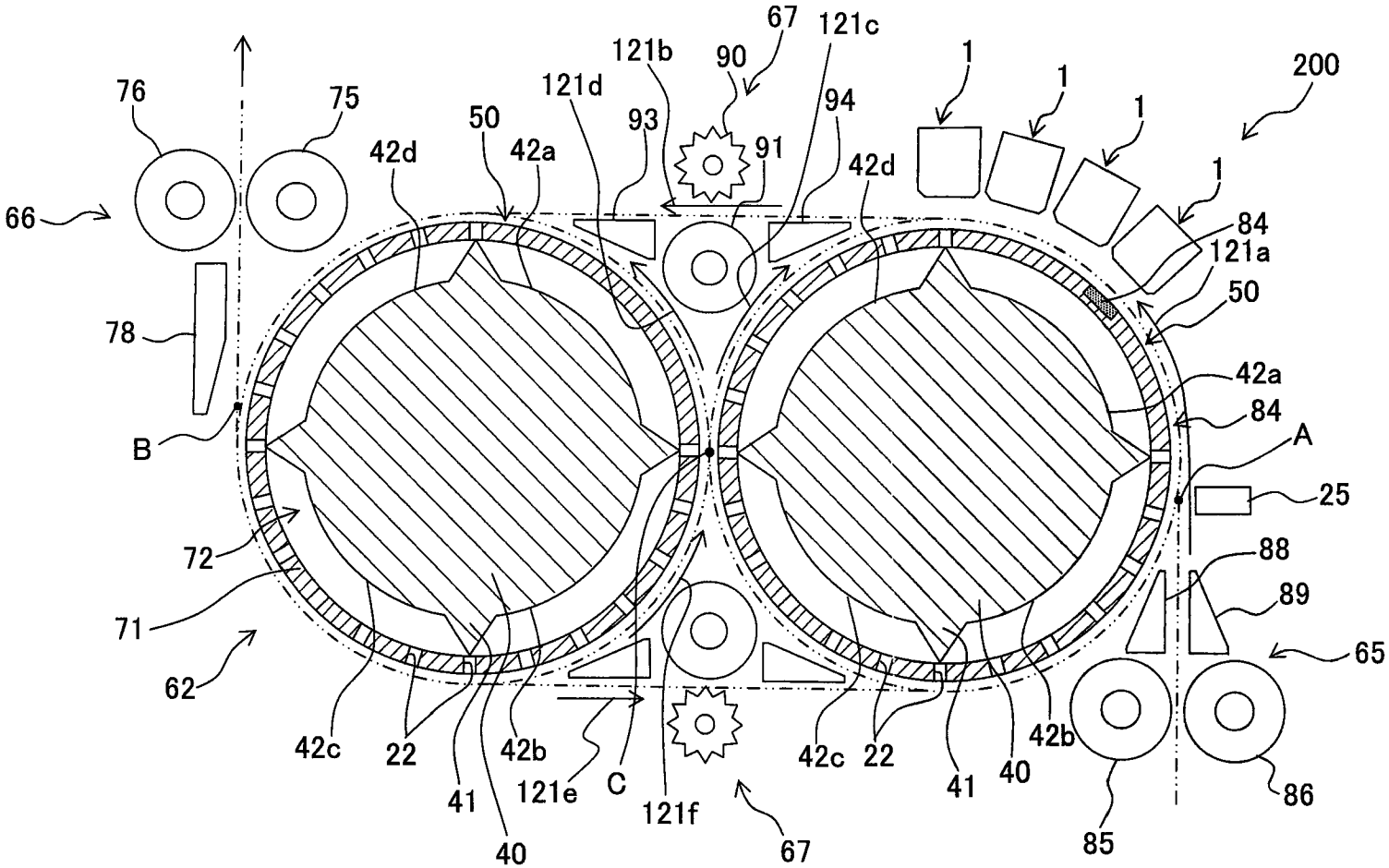
FIG. 9 is a schematic view showing the structure of a printer according to a second embodiment.
Figure 10:
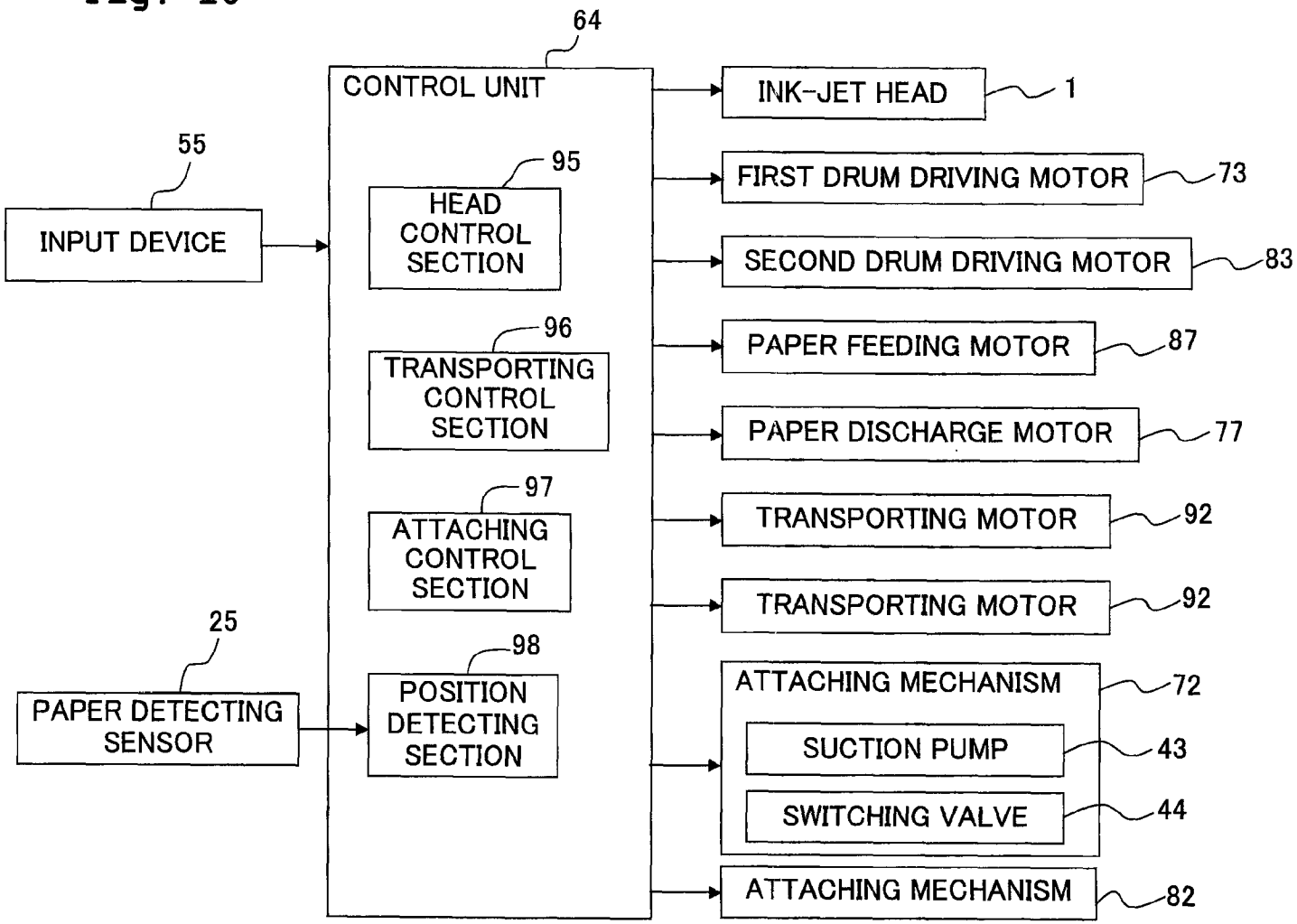
FIG. 10 is a block diagram schematically showing the electrical configuration of the printer according to the second embodiment.

As shown in FIGS. 9 and 10, the printer 200 of the second embodiment includes four ink-jet heads 1 jetting inks to the printing paper P (printing medium) to print on the printing paper P, a reversing mechanism 62 turning the printing paper P upside down, a transporting mechanism 63 transporting the printing paper P between the ink-jet heads 1 and the reversing mechanism 62, a control unit 64 controlling the whole printer 200, and so on.

The four ink-jet heads 1 jet four color inks respectively to the printing paper P transported by the transporting mechanism 63 to print on the printing paper P. Further, the ink-jet head 1 is not limited to that having a specific structure and may be, for example, a line-type head or a serial-type head.

Further, the reversing mechanism 62 in the second embodiment has a structure similar to that of the first embodiment. That is, the reversing mechanism 62 has a first drum 71 rotatably structured, a sucking mechanism 72 (first sucking mechanism, first attaching mechanism) disposed in an inner space of the first drum 71 to suck the printing paper P onto an outer peripheral surface of the first drum 71, a first drum driving motor 73 (first rotational drive mechanism) rotary-driving the first drum 71, and so on. Further, the sucking mechanism 72 also includes, as in the first embodiment, a columnar fixed body 40, four partitioning walls 41 provided on an outer peripheral surface of the fixed body 40, and four decompression chambers 42*a* to 42*d* which are demarcated by the four partitioning walls 71 and arranged in a circumferential direction, and these decompression chambers 42*a* to 42*d* are connected to a suction pump 43 via switching valves 44 respectively. The operation of the sucking mechanism 72 when sucking the printing paper P by reducing the pressures of the decompression chambers 42 via through holes 22 provided in the drum 71 is basically the same as that in the first embodiment.

The reversing mechanism 62 rotates the first drum 71 while the printing paper P transported thereto by the transporting mechanism 63 (to be described later) from the ink-jet heads 1 is sucked on the first drum 71, and thereafter the sucking mechanism 72 cancels the pressure-reduced state of a specific one of the decompression chambers 42. Consequently, the printing paper P is separated from the first drum 71 and at the same time, is turned upside down to be delivered to the transporting mechanism 63 again.

The transporting mechanism 63 is disposed adjacently to the first drum 71 of the reversing mechanism 62 in terms of a radial direction, and includes a second drum 81 structured rotatably, a sucking mechanism 82 (second sucking mechanism) disposed in an inner space of the second drum 81 to suck the printing paper P onto an outer peripheral surface of the second drum 81, a second drum driving motor 83 (second rotational drive mechanism) rotary-driving the second drum 81, and so on.

The outer peripheral surface of the second drum 81 faces the above-described four ink-jet heads 1, and the ink-jet heads 1 jet the inks to the printing paper P held on the outer peripheral surface of the second drum 81 by the sucking mechanism 72, to print on the printing paper P. Further, on the outer peripheral surface of the second drum 81, an ink receiving member 84 is provided to receive the inks jetted from nozzles of the ink-jet heads at the time of flashing of the nozzles.

Similarly to the sucking mechanism 72 provided in the first drum 71, the sucking mechanism 82 provided in the second drum 81 includes a columnar fixed body 40, four partitioning walls 41 provided on an outer peripheral surface of the fixed body 40, and four decompression chambers 42*a* to 42*d* demarcated by the four partitioning walls 41 and arranged in the circumferential direction, and these decompression chambers 42*a* to 42*d* are connected to a suction pump 43 via switching valves 44 respectively. Further, the operation of sucking the printing paper P onto an outer peripheral surface of the drum 81 via through holes 22 provided in the drum 81 is also the same.

The transporting mechanism 63 rotates the second drum 81 while the printing paper P is sucked on the outer peripheral surface of the second drum 81 by the sucking mechanism 82, to move the printing paper P subjected to the printing by the ink-jet heads 1, in the circumferential direction of the drum, thereby transporting the printing paper P between the ink-jet heads 1 and the first drum 71 of the reversing mechanism 62.

Similarly to the drum 16 of the first embodiment, the first drum 71 of the reversing mechanism 62 and the second drum 81 of the transporting mechanism 63 have, on their outer peripheral surfaces, partial areas 50 without any through hole 22. When the printing paper P is sucked to the drum 71 (81), a leading end portion of the printing paper P is sucked via the through hole 22 closest to the partial area 50 in terms of a direction opposite a rotation direction of the drum 71 (81), thereby preventing the through hole 22 closed by the leading end portion and another through hole 22 in an open state from communicating with the same decompression chamber 42 to prevent a decrease in a force sucking the leading end portion.

Further, at a predetermined position on a tangent of the second drum 81 out of the two drums 71, 81, a paper feeding mechanism 65 feeding the printing paper P toward the second drum 81 is provided. The paper feeding mechanism 65 includes a paper feeding roller 85, a nip roller 86, a paper feeding motor 87 (see FIG. 10) rotary-driving the paper feeding roller 85, paper feeding guides 88, 89, and so on, and feeds the printing paper P sandwiched by the paper feeding roller 85 and the nip roller 86 to the second drum 81 via the paper feeding guides 88, 89. At a paper feeding position (position A in FIG. 9) at which the printing paper P is fed from the paper feeding mechanism 65 to the second drum 81, a paper detecting sensor 25 detecting that the printing paper P has been fed is provided.

Further, at a predetermined position on a tangent of the first drum 71, a paper discharge mechanism 66 discharging the printing paper P transported by the first drum 71 is provided. The paper discharge mechanism 66 includes a paper discharge roller 75, a nip roller 76, a paper discharge motor 77 (see FIG. 10) rotary-driving the paper discharge roller 75, a paper discharge guide 78, and so on, and sandwiches the printing paper P, which is sent thereto from the first drum 71 via the paper discharge guide 78, by the paper discharge roller 76 and the nip roller 76 to discharge the printing paper P.

Further, on two common outer tangents extending from the first drum 71 to the second drum 81, two holding mechanisms 67 are provided respectively to hold the printing paper P delivered between the first drum 71 and the second drum 81. The two holding mechanisms 67 have the same structure. Specifically, each of the holding mechanisms 67 includes a first transporting roller 90 having a plurality of projections arranged in its circumferential direction, a second transporting roller 91 in a cylindrical shape facing the first transporting roller 90 across the printing paper P, a transporting motor 92 rotary-driving the second transporting roller 91, and paper transporting guides 93, 94 disposed on both sides, in terms of a transporting direction (right and left direction in FIG. 9), of a roller pair composed of the first transporting roller 90 and the second transporting roller 91. When the printing paper P is delivered between the first drum 71 and the second drum 81, the printing paper P separates from the drum 71 (81) for a moment, but at this time, the holding mechanism 67 fastens the printing paper P by sandwiching the printing paper P by the first transporting roller 90 and the second transporting roller 91, thereby preventing the printing paper P from curling.

When the printing paper P having been subjected to the printing by the ink-jet heads 1 is delivered from the second drum 81 to the first drum 71 on the common outer tangent, a surface on which the printing is performed immediately before the delivery faces outward relative to the two common outer tangents (toward a side opposite the drums 71, 81). The first transporting rollers 90 having the projections out of the first transporting rollers 90 and the second transporting rollers 91 of the holding mechanisms 67 are disposed on the outer side of the common outer tangents. That is, the first transporting rollers 90 with a smaller contact area with the printing paper P, out of the first transporting rollers 90 and the second transporting rollers 91, come into contact with the surface on which the printing has just been performed. Therefore, it is possible to prevent the printed surface from being stained when the printing paper P is transported.

A control unit 64 (printing control mechanism) shown in FIG. 10 includes a head control section 95, a transporting control section 96, a suction control section 97 (attaching control section), and a position detecting section 98. The head control section 95 controls the ink-jet heads 1 based on printing data input from an input device 55 such as a PC so that the ink-jet heads 1 jet the inks toward the printing paper P to print a desired image or the like on the printing paper P. Further, the transporting control section 96 controls the first drum driving motor 73 and the second drum driving motor 83 rotary-driving the first drum 71 and the second drum 81 respectively, the paper feeding motor 87 of the paper feeding mechanism 65, the paper discharge motor 77 of the paper discharge mechanism 66, the transporting motors 92 of the two holding mechanisms 67 so that the first drum 71 and the second drum 81 transport the printing paper P.

Further, the suction control section 97 controls the suction pumps 43 and the switching valves 44 of the two sucking mechanisms 72, 82 provided in the two drums 71, 81 so that the sucking mechanisms 72, 82 suck the printing paper P onto the drums 71, 81 and deliver the printing paper P between the first drum 71 and the second drum 81.

Here, a supplementary description will be given of the delivery of the printing paper P between the two drums 71, 81 by controlling the two sucking mechanisms 72, 82. At the time of the delivery, the suction control section 97 decreases the sucking force of the delivery-origin drum to release the printing paper P from this drum as well as increasing the sucking force of the delivery-destination drum to suck the printing paper P, which has been released from the delivery-origin, to the delivery-destination drum.

More concretely, while the two drums 71, 81 are both rotating, by using the switching valve 44, the decompression chamber 42 corresponding to an area from which the leading end portion of the printing paper P is to be peeled off, among the four decompression chambers 42*a* to 42*d* provided in the delivery origin drum, is caused not to communicate with the suction pump 43 to be released from the pressure-reduced state, so that the leading end portion of the printing paper P is released from the delivery origin drum. At the same time, in the delivery destination drum, the decompression chamber 42 corresponding to an area receiving the leading end portion of the printing paper P is made to communicate with the suction pump 43 by the switching valve 44 to be brought into the pressure-reduced state, so that the leading end portion of the printing paper P released from the delivery origin drum is sucked. Consequently, the printing paper P is delivered to the delivery destination drum.

The position detecting section 98 detects the leading end position of the printing paper P which is being transported, based on a paper feeding timing at which the printing paper P detected by the paper detecting sensor 25 is fed to the first drum 71 and information regarding the numbers of rotations of the first drum 71 and the second drum 81. Information on the leading end position of the printing paper P detected by the position detecting section 98 is used in controlling the liquid droplet jetting of the ink-jet heads 1.

Further, as previously described, when the printing paper P is sucked to the drums 71, 81, the drum driving motors 73, 83 are controlled so that the leading end portion of the printing paper P is sucked by the through hole 22 closest to the partial area 50 (area without any through hole 22) in terms of the direction opposite the rotation direction of the drums 71, 81, for the purpose of preventing a decrease in the force sucking the leading end portion. In this control, the information regarding the leading end position of the printing paper P detected by the position detecting section 98 is also used.

Next, a series of operations of the printer 200 at the time of the double-sided printing (especially, a paper transporting operation will be described with reference to the drawings.

Figure 11:
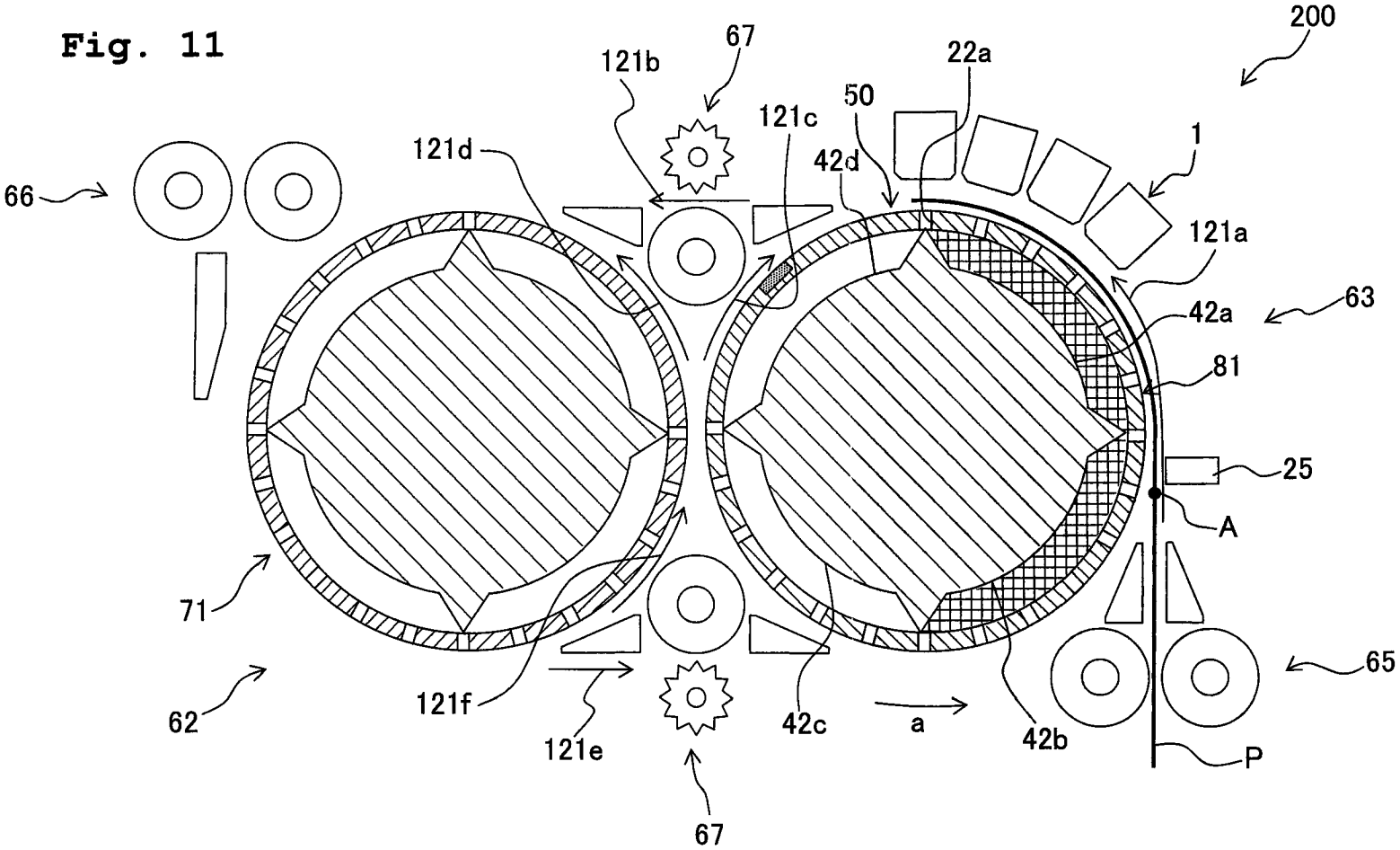
FIG. 11 is a view showing the operation (paper feeding and front surface printing) of the printer at the time of the double-sided printing.

As shown in FIG. 11, first, when the printing paper P fed from the paper feeding mechanism 65 is detected by the paper detecting sensor 25, the sucking mechanism 82 of the second drum 81 in the transporting mechanism 63 reduces the pressures of the decompression chambers 42*a*, 42*b* to suck the leading end portion of the printing paper P to the second drum 81. At this time, the pressures in the other decompression chambers 42*c*, 42*d* are not reduced.

Further, at this time, the transporting control section 96 controls the rotation of the second drum 81 (rotary-driving by the second drum driving motor 83) based on the leading end position of the printing paper P detected by the position detecting section 98 so that the leading end portion of the printing paper P is sucked to the through hole 22*a* closest, in terms of the direction opposite the rotation direction (arrow "a" direction), to the area 50 without any through hole 22 of the second drum 81. Note that the above control for sucking the leading end portion of the printing paper P to a predetermined position is always performed when the drum (any of the first drum 71 and the second drum 81) receives the printing paper P, in order to maintain the force sucking the leading end portion of the printing paper P, and description of this control will be omitted hereinafter.

Thereafter, the transporting control section 96 controls the second drum driving motor 83 so that the second drum 81 rotates in an anticlockwise direction (arrow "a" direction) while the printing paper P is sucked on the second drum 81, and the printing paper P is transported to a position facing the ink-jet heads 1. At this time, the ink-jet heads 1 print on one surface (front surface) of the printing paper P. In other words, as shown in FIG. 11, the printing paper P is transported via a transporting route 121*a* extending from the paper feeding mechanism 65 to an area, of the second drum 81, facing the ink-jet heads 1, and the printing paper P is subjected to printing on the front surface.

Figure 12:
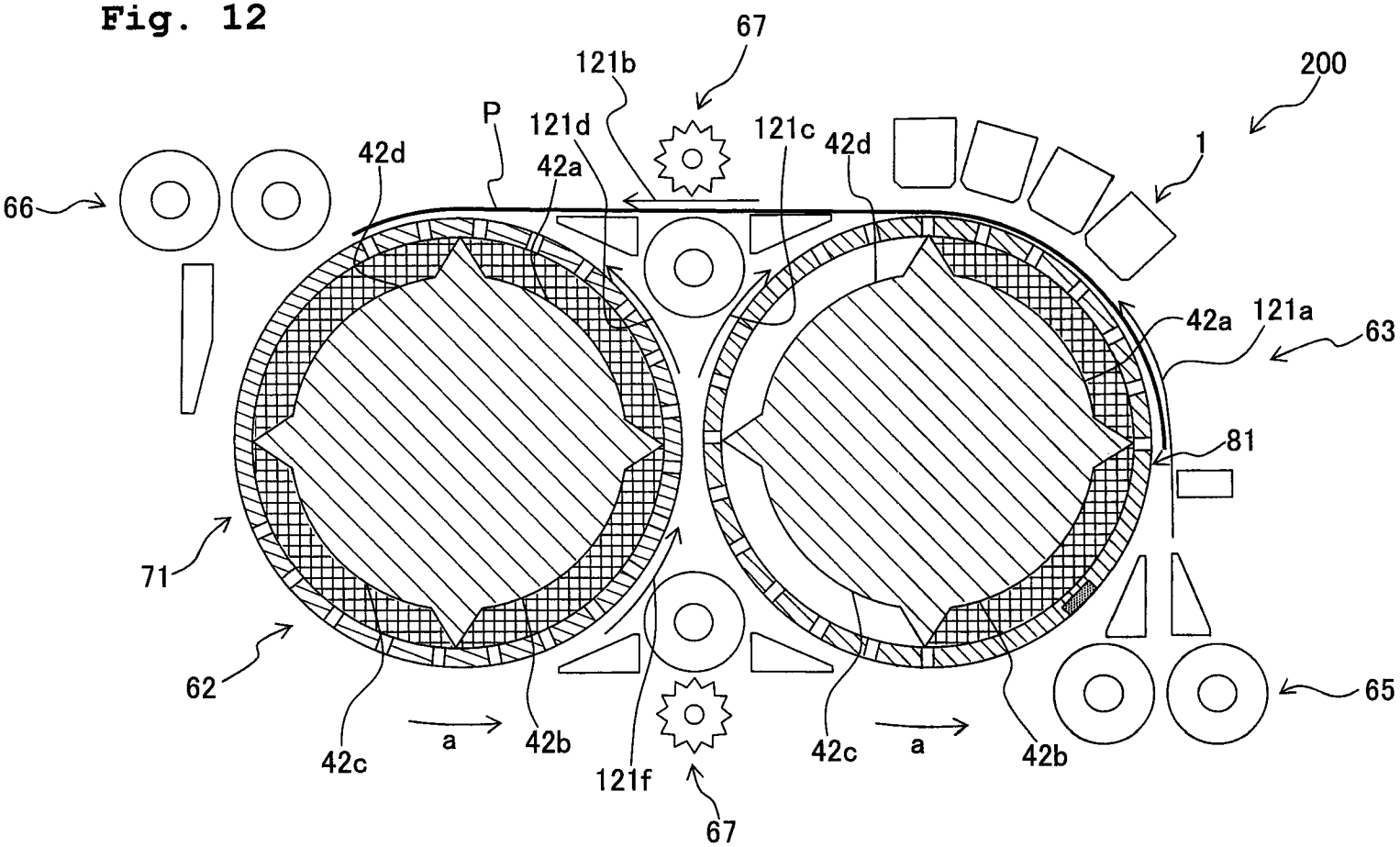
FIG. 12 is a view showing the operation (delivery on a common outer tangent after the front surface printing) of the printer at the time of the double-sided printing.

Next, while the second drum 81 is kept rotating in the arrow "a" direction, the first drum driving motor 73 is controlled so that the first drum 71 of the reversing mechanism 62 rotates in the same direction as the rotation direction (arrow "a" direction) of the second drum 81. Consequently, as shown in FIG. 12, the printing paper P is released from the second drum 81 on an area, of the outer peripheral surface of the second drum 81, corresponding to the decompression chamber 42*d* of which pressure has not been reduced, and further, the printing paper P is sent to the first drum 71 while held by the holding mechanism 67 located on one of (the upper one of) the common outer tangents between the first drum 71 and the second drum 81. At the same time, the sucking mechanism 72 of the first drum 71 is caused to reduce the pressures of the four decompression chambers 42*a* to 42*d*. Consequently, the leading end portion of the printing paper P released from the second drum 81 is sucked to an area, of the first drum 71, corresponding to the decompression chamber 42*d*, so that the printing paper P is delivered on the common outer tangent from the second drum 81 of the transporting mechanism 63 to the first drum 71 of the reversing mechanism 62. Note that when delivered on the common outer tangent, the printing paper P is not turned upside down. That is, the printing paper P is delivered to the first drum 71 while its front surface on which the printing has just been performed faces outward (is exposed). In other words, as shown in FIG. 12, the printing paper P having passed through the transporting route 121*a* passes through a delivery route 121*b* which extends from the second drum 81 to the first drum 71 via the upper holding mechanism 67 and is delivered to the first drum 71.

Figure 13:
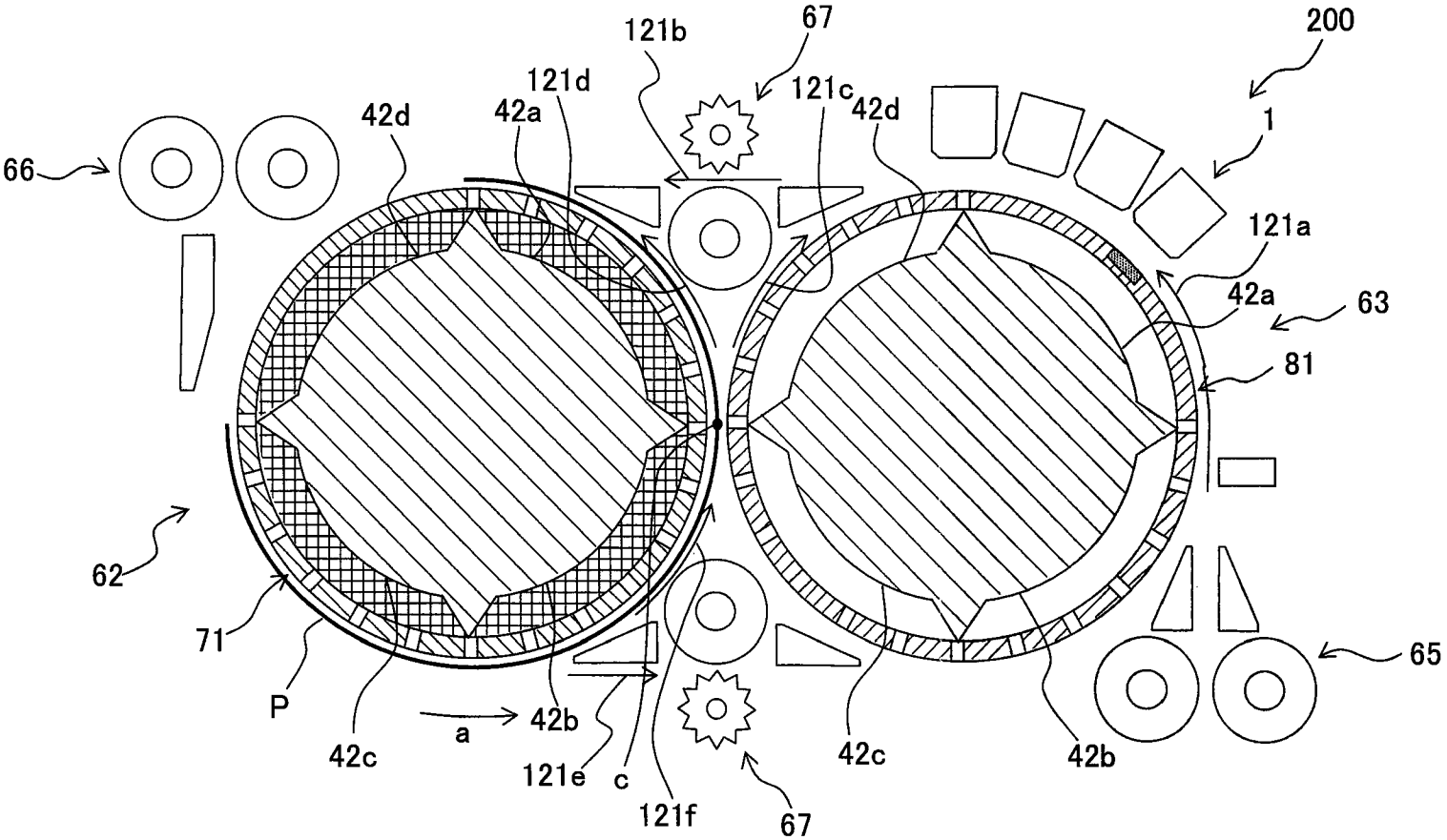
FIG. 13 is a view showing the operation (front surface drying) of the printer at the time of the double-sided printing.

Next, as shown in FIG. 13, the first drum 71 is rotated in the a direction by the first drum driving motor 73 while the printing paper P is sucked on the outer peripheral surface of the first drum 71, thereby transporting the printing paper P in the a direction. Then, when the first drum 71 makes a ¾ rotation, the leading end portion of the printing paper P moves to a most proximal point C between the first drum 71 and the second drum 81. Here, if the purpose is only to turn the printing paper P upside down, it is only necessary to cancel the pressure-reduced state of the decompression chamber 42*a* to deliver the printing paper P from the first drum 71 to the second drum 81 at the most proximal point C. In the second embodiment, however, in order to fully dry the ink on the front surface of the printing paper P having been subjected to the printing by the ink-jet heads 1, the pressure-reduced state of the decompression chamber 42*a* is not cancelled and the first drum 71 is caused to further make one rotation or more. In other words, as shown in FIG. 13, at the most proximal point C, the printing paper P having passed through the first delivery route 121*b* to be delivered to the first drum 71 does not move to a first reversing route 121*c* directed toward the second drum 81 but moves to a route 121*d* corresponding to an area, of the first drum 71, facing the upper holding mechanism 67. Consequently, the printing paper P is not turned upside down and further rotates while being sucked to the front surface of the first drum 71.

It is preferable, as in the first embodiment, that the transporting control section 96 decides the total number of rotations that the first drum 71 makes during a period from the suction of the printing paper P up to the separation (delivery) thereof based on the printing duty (an amount of the inks jetted) for the front surface printing.

Figure 14:
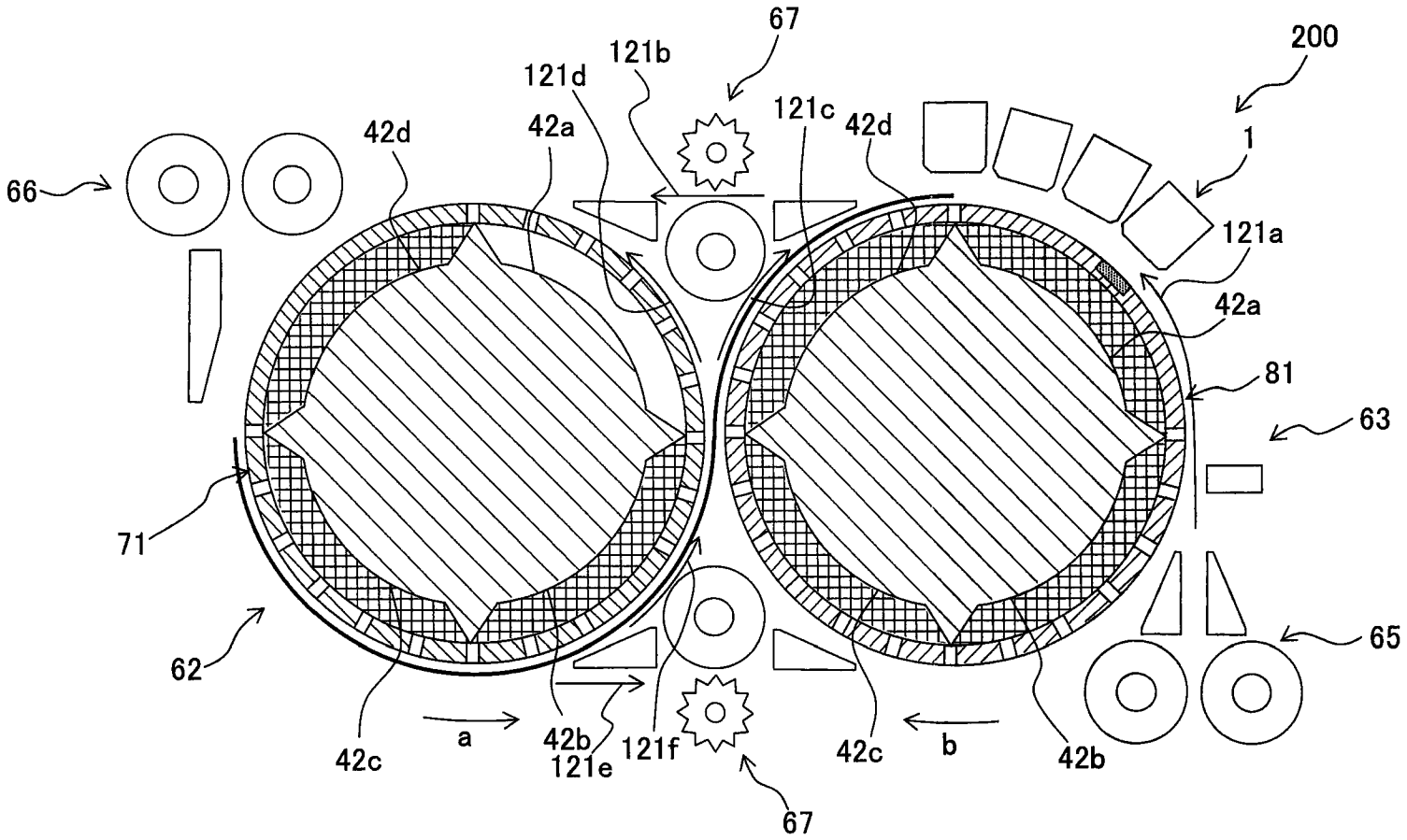
FIG. 14 is a view showing the operation (delivery at a most proximal point) of the printer at the time of the double-sided printing.

Then, after the total number of rotations of the first drum 71 reaches a predetermined number or more after the printing paper P is sucked, when the leading end portion of the printing paper P moves again to the most proximal point C between the first drum 71 and the second drum 81, the pressure-reduced state of the decompression chamber 42*a* of the first drum 71 is cancelled as shown in FIG. 14. At the same time, the four decompression chambers 42*a* to 42*d* of the second drum 81 are brought into the pressure-reduced state and the second drum 81 is rotated by the second drum driving motor 83 in a direction (arrow "b" direction) opposite the rotation direction of the first drum 71. Consequently, on an area, of the first drum 71, corresponding to the decompression chamber 42*a* whose pressure has not been reduced, the printing paper P is released from the first drum 71 and the released printing paper P is sucked to an area, of the second drum 81, corresponding to the decompression chamber 42*d*, so that the printing paper P is delivered from the first drum 71 to the second drum 81 at the most proximal point C. When delivered at the most proximal point C, the printing paper P is turned upside down and is sucked to the second drum 81 so that the unprinted surface (rear surface) faces outward. In other words, as shown in FIG. 14, the printing paper P having passed through the most proximal point C of the first drum 71 passes through the first reversing route 121*c* to move to the second drum 81. At this time, the printing paper P is reversed and brought into a state where its rear surface (unprinted surface) is exposed.

The second drum 81 is rotated in the arrow "b" direction while the printing paper P of which rear surface is thus exposed is sucked thereto to convey the printing paper P turned upside down to the ink-jet heads 1 again. Then, the ink-jet heads 1 are made to print on the rear surface of the printing paper P.

Figure 15:
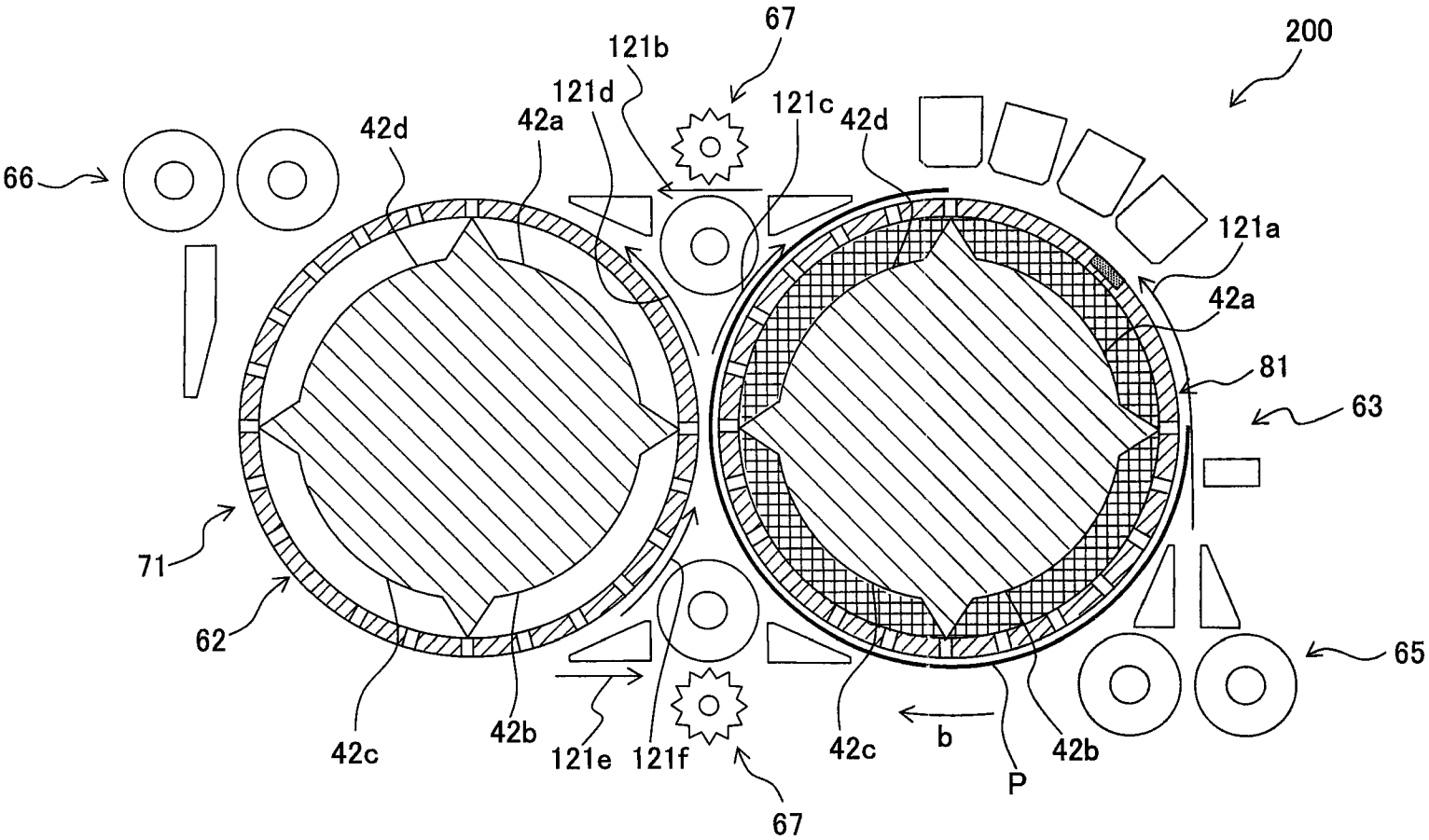
FIG. 15 is a view showing the operation (rear surface drying) of the printer at the time of the double-sided printing.

Thereafter, when the second drum 81 makes a ¾ rotation in the arrow "b" direction after the printing paper P is sucked to the second drum 81, the leading end portion of the printing paper P reaches the common outer tangent. Here, the printing paper P may be directly delivered to the first drum 71 on the common outer tangent to be discharged from the paper discharge mechanism 66, but in the second embodiment, in order to fully dry the ink on the rear surface of the printing paper P on which the ink-jet heads 1 have printed, the second drum 81 is caused to further make one rotation or more while the four decompression chambers 42*a* to 42*d* are kept in the pressure-reduced state as shown in FIG. 15. In other words, the printing paper P having been subjected to the printing on rear surface does not move to a second delivery route 121*e* extending from the second drum 81 to the first drum 71 via the lower holding mechanism 67 but is transported along a route 121*f*, on the second drum 81, extending toward the most proximal point C.

Incidentally, as in the previously described case where the second drum 81 is rotated in order to dry the front surface, it is preferable also in this drying of the rear surface that the transporting control section 96 decides the total number of rotations that the second drum 81 makes during a period from the suction of the printing paper P up to the separation (delivery) thereof, based on the printing duty (an amount of the inks jetted) for the rear surface printing.

Figure 16:
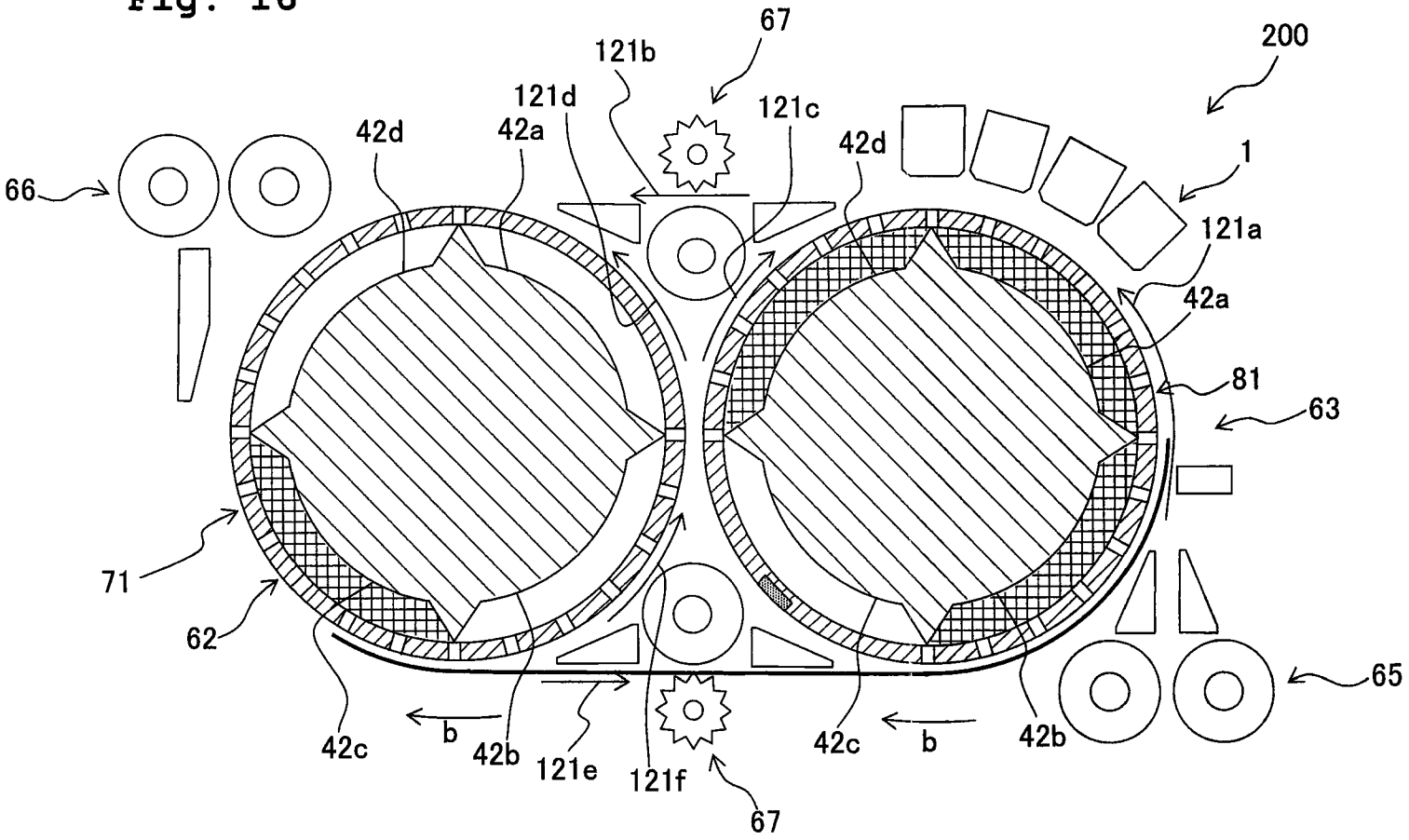
FIG. 16 is a view showing the operation (delivery on a common outer tangent after the rear surface printing) of the printer at the time of the double-sided printing.

Then, after the total number of rotations of the second drum 81 reaches a predetermined number or more after the printing paper P is sucked, when the leading end portion of the printing paper P moves to the common outer tangent of the first drum 71 and the second drum 81, the printing paper P having been subjected to the printing on the rear surface is held by the holding mechanism 67 to be delivered to the first drum 71 on the common outer tangent of the first drum 71 and the second drum 81 while the second drum 81 is rotated in the same direction as the rotation direction (arrow "b" direction) of the first drum 71, as shown in FIG. 16. In other words, the printing paper P passes through the second delivery route 121*e* to be delivered from the second drum 81 to the first drum 71. The operation at this time such as the switching of the pressure-reduced state of the decompression chambers 42 is the same as that at the time of the delivery described in FIG. 12, and detailed description thereof will be omitted.

Figure 17:
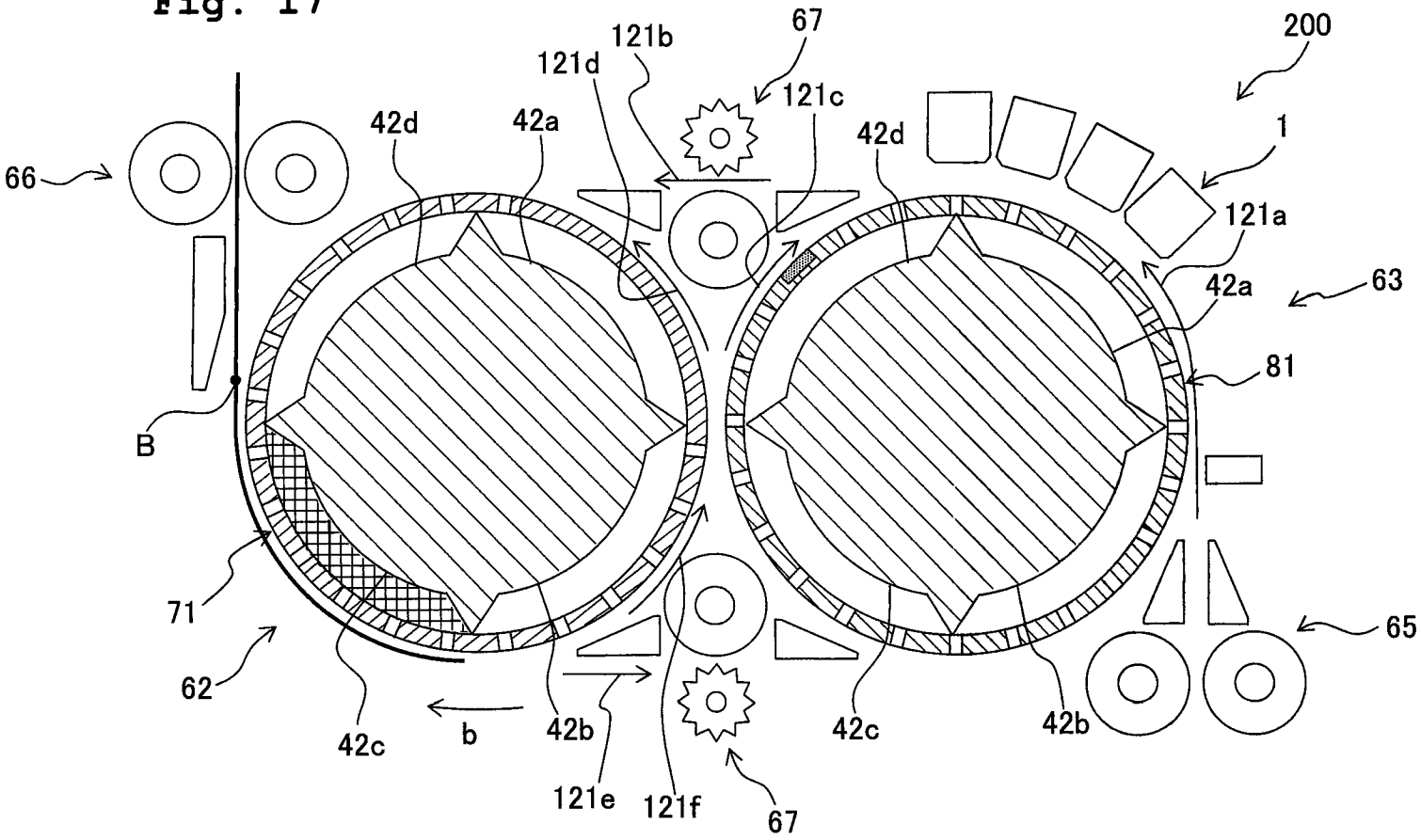
FIG. 17 is a view showing the operation (paper discharge) of the printer at the time of the double-sided printing.

Finally, as shown in FIG. 17, after the printing paper P is transported to a position near the paper discharge mechanism 66 (paper discharge position B) by the rotation of the first drum 71, the printing paper P is released from the first drum 71 on an area corresponding to the decompression chamber 42*d* whose pressure has not been reduced, and the printing paper P having been subjected to the printing on the both surfaces is discharged from the first drum 71 by the paper discharge mechanism 66.

According to the printer of the second embodiment described above, during the period from the time when the printing paper P having been subjected to the printing on the front surface is sucked to the first drum 71 of the reversing mechanism 62 up to the time when the printing paper P separates from the first drum 71, the first drum 71 is caused to make one rotation or more, which makes it possible to fully dry the front surface of the printing paper P. Further, the printing paper P is delivered from the first drum 71 to the second drum 81 while being turned upside down at the most proximal point C, and even after the ink-jet heads 1 perform the printing on the rear surface of the printing paper P, the second drum 81 is caused to make one rotation or more before the printing paper P separates from the second drum 81. This makes it possible to discharge the printing paper P after the rear surface thereof is fully dried.

Incidentally, in the drawings used to describe the second embodiment, the first drum 71 of the reversing mechanism 62 and the second drum 81 of the transporting mechanism 63 are depicted as drums equal in diameter, but the two drums 71, 81 need not be equal in diameter but may be different in diameter.

For example, between the drying of the front surface and the drying of the rear surface of the printing paper P, the drying of the front surface preceding the reversing has a higher level of importance. Therefore, the first drum 71 of the reversing mechanism 62 which is caused to make one rotation or more at the time when the front surface is dried may be larger in diameter than the second drum 81 of the transporting mechanism 63 which is rotated at the time when the rear surface is dried, so as to enable more efficient drying of the front surface of the printing paper P even with the same number of rotations.

In the foregoing, the first embodiment and the second embodiment are described as examples of embodiments of the present invention, but applicable forms of the present invention are not limited to such embodiments, and various modifications may be made to the above embodiments without departing from the spirit of the present invention. Several examples of the modification will be shown below.

First Modification

In the first embodiment and the second embodiment, based on the printing duty of the front surface or the rear surface of the printing paper P, the total number of rotations that the drum 16 (71, 81) makes during the period from the suction of the printing paper P up to its separation is decided (changed), but a condition other than the total number of rotations of the drum may be changed.

For example, the rotation speed of the drum may be decided based on the printing duty. More concretely, the higher the printing duty, the more difficult it is to dry the ink. Therefore, by increasing the rotation speed of the drum to accelerate the air flow along the outer peripheral surface of the drum, the drying may be promoted. Alternatively, the time of the continuous rotation that the drum makes during the period from the suction to the separation of the printing paper P may be decided based on the printing duty. That is, the higher the printing duty, the more difficult it is to dry the ink. Therefore, the drying time may be reserved by increasing the continuous rotation time of the drum. Alternatively, while the total number of rotations is set constant, the rotation speed may be set lower as the printing duty is higher. This can also increase the time of the continuous rotation as the printing duty increases, which makes it possible to reserve the drying time.

Instead of deciding the total number of rotations of the drum according to the printing duty, by deciding the rotation speed or the continuous rotation time of the drum according to the printing duty, it is also possible to surely dry the front surface in the minimum required time. Incidentally, the rotation time, the rotation speed, or the like of the drum may be fixed to a predetermined fixed value, instead of changing depending on the printing duty.

Second Modification

In the first embodiment and the second embodiment, in order to fully dry the front surface of the printing paper P, the drum 16 (71) is rotated a larger number of times (one rotation or more) than the number of rotations necessary for turning the printing paper P upside down (¾ rotation), but instead of causing the drum to make such an additional rotation, the rotation of the drum may be once stopped and the printing paper P may be kept sucked for a predetermined time. Note that this predetermined time (standby time) may also be decided based on the printing duty. That is, the higher the printing duty, the more difficult it is to dry the ink, and thus the longer the standby time is set.

Incidentally, the rotation condition (the continuous rotation time, the total number of rotations, the rotation speed, the standby time, or the like) of the first drum may be decided based on an environmental condition (humidity, temperature, or the like) in the printer, instead of the printing duty or in addition to the printing duty. For example, the printing duty may be decided based on humidity information obtained from a hygrometer disposed at a predetermined position in the printer (position near a printed recording surface of the printing paper, or the like). Humidity in the environment around the printing surface in a state where the ink is not completely dried is thought to be higher than humidity in a state where the ink is completely dried. Further, it is thought that the ink dries more quickly when environmental temperature in the printer is high than when the environmental temperature is low, and therefore, the predetermined time may be decided, taking the environmental temperature into consideration.

Third Modification

The structure of the sucking mechanism sucking the printing paper P to the drum is not limited to the structures in the above-described embodiments, and may be appropriately changed. For example, a plurality of suction pumps 43 may be connected to a plurality of decompression chambers 42 in one-to-one correspondence. In this case, it is possible to realize the pressure-reduction of each of the decompression chambers 42 by controlling a sucking force of the corresponding suction pump 43 or controlling ON/OFF of the corresponding suction pump 43.

Further, the partitioning walls 41 demarcating the decompression chambers 42 may be provided on an inner surface of the drum instead of the outer peripheral surface of the fixed body 40. Further, between the drum and the fixed body 40, the plural decompression chambers 42 in one-to-one correspondence to the plural through holes 22 formed in the drum may be formed.

Further, the sucking mechanism as an example of an attaching mechanism is not limited to one using the pressure-reduction (suction) of the decompression chambers 42 as in the above-described embodiments. For example, it may be what is called an electrostatic attaching mechanism that generates static electricity on the outer peripheral surface of the drum to attract the printing paper P.

Fourth Embodiment

As the separating mechanism separating the printing paper P from the drum of the reversing mechanism, the structure changing the sucking force of the drum by switching the pressure-reduced state of the decompression chamber is shown as an example in the above-described embodiments, but the separating mechanism is not limited to such a structure. For example, the separating mechanism may be structured to include a roller, a paper guide, or the like in contact with the outer peripheral surface of the drum and directly apply a release force to the printing paper P to forcibly peel off the printing paper P from the outer peripheral surface of the drum. In this case, adjusting the position of the roller or the like enables the printing control mechanism to execute a mode in which the printing paper P is separated from the outer peripheral surface of the drum and a mode in which the printing paper P is not separated from the outer peripheral surface of the drum but is kept sucked on the outer peripheral surface of the drum. Note that the position at which the printing paper P is separated from the outer peripheral surface of the drum is not limited to the positions shown in the above-described embodiments and modifications but may be any.

Fifth Modification

Figure 18:
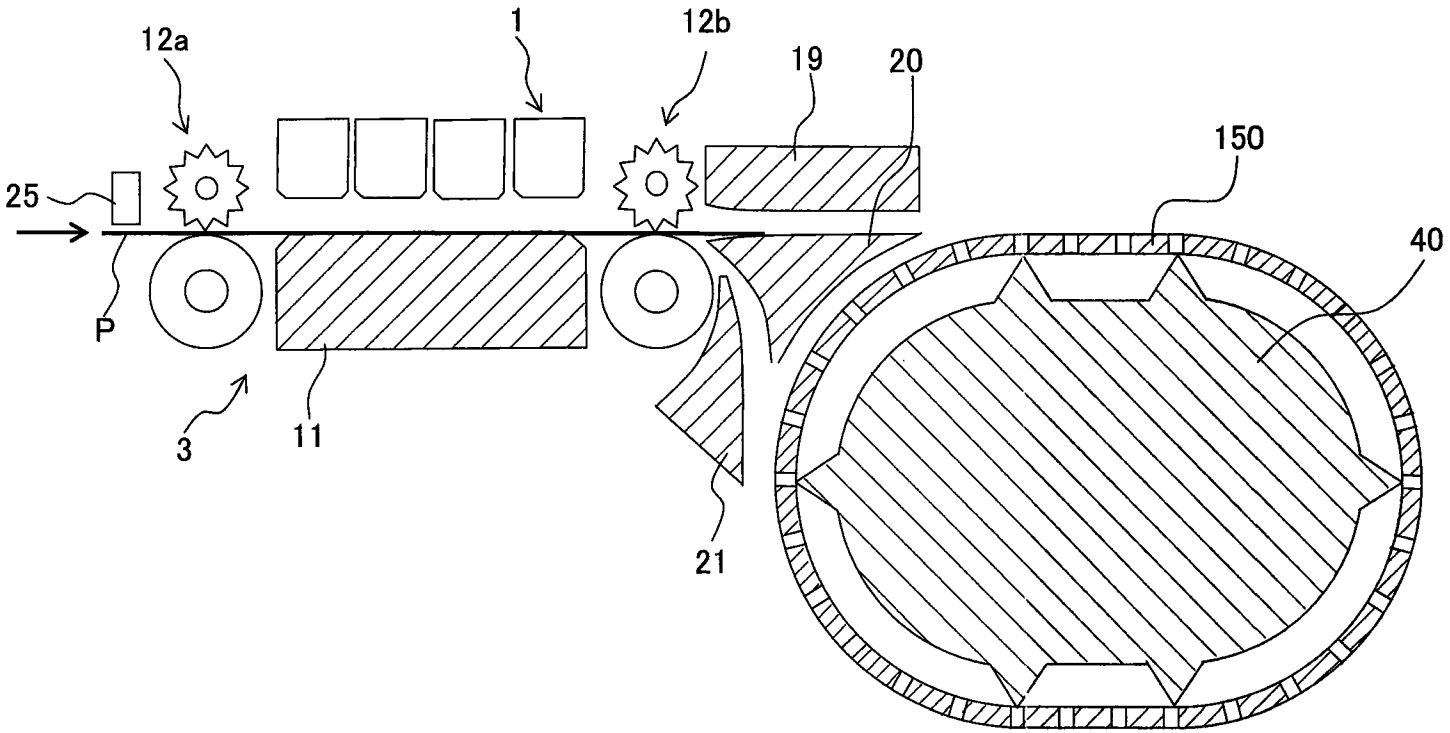
FIG. 18 is a schematic view showing the structure of a printer using an endless belt.

In the above-described embodiments and modifications, the reversing mechanism has the drum and the printing paper P is sucked to the front surface of the drum, but the present invention is not limited to this. For example, as shown in FIG. 18, an endless belt disposed to surround a plurality of shafts (FIG. 18 shows an example where three shafts 151*a* to 151*c* are provided) may be used instead of the drum. In this case, both side surfaces of the endless belt 150 may be airtightly covered and an inner space surrounded by the endless belt 150 may be pressure-reducible as in the above-described embodiment. Alternatively, on a front surface of the endless belt 150, the aforementioned electrostatic sucking mechanism may be provided.

Figure 19:
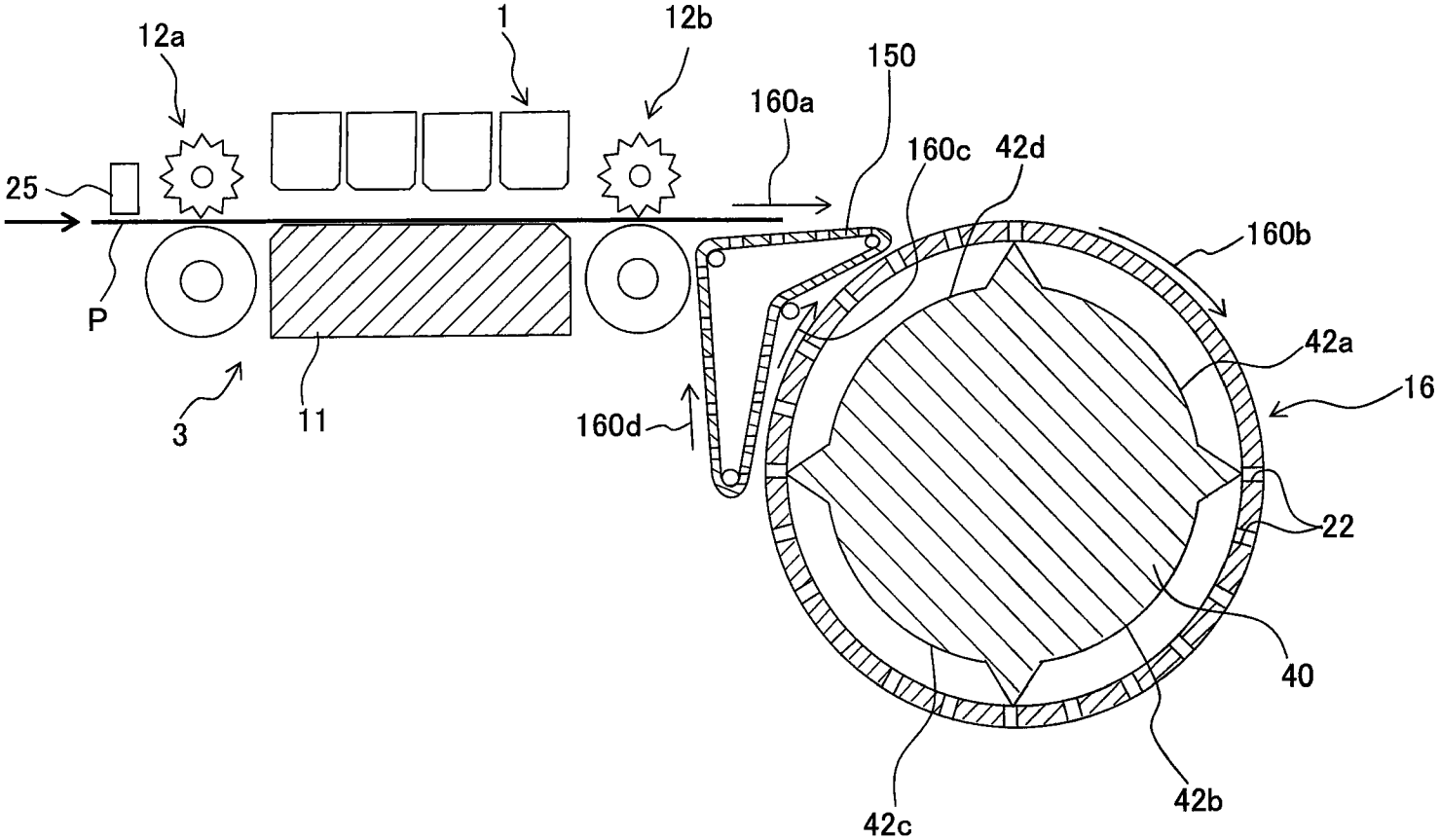
FIG. 19 is a schematic view of a printer using a combination of a drum and an endless belt.

Further, as shown in FIG. 19, the endless belt 150 and the drum 16 may be combined. In this case, the printing paper P sent via the transporting route 10 of the printing paper P is sucked to the front surface of the endless belt 150 to be delivered to the drum 16 via an upper feeding route (first route 160*a*). At this time, by sucking the printing paper P to the drum 16 near a boundary between the drum 16 and the endless belt 150 while canceling the suction of the endless belt 150, it is possible to transport the printing paper P from the endless belt 150 to the drum 16. Thereafter, as described above, the drum 16 makes one rotation or more while the printing paper P is sucked on the front surface of the drum 16, whereby the ink on the printing paper P is dried. In other words, when the ink on the printing paper P is dried, the printing paper P passes through both a route (second route 160*b*) corresponding to an area, of the front surface of the drum 16, not facing the endless belt 150 and a route (third route 160*c*) corresponding to an area, of the front surface of the drum 16, facing the endless belt 150. Thereafter, the printing paper P transported through the second route 160*b* is not sent to the third route 160*c* but is sent to a lower return route (fourth route) of the endless belt 150. At this time, contrary to the above case, near the boundary between the drum 16 and the endless belt 150, the printing paper P is sucked to the endless belt 150 while the suction of the drum 16 is cancelled, whereby it is possible to convey the printing paper P from the drum 16 to the endless belt 150.

What is claimed is:

1. A printer which performs printing by jetting an ink onto a printing medium, the printer comprising:

an ink-jet head jetting the ink onto the printing medium;

a first rotatable body which has an outer peripheral surface;

a first attaching mechanism attaching the printing medium to the outer peripheral surface of the first rotatable body;

a separating mechanism separating the printing medium attached to the outer peripheral surface of the first rotatable body from the first rotatable body;

a first rotational drive mechanism driving the first rotatable body; and a control mechanism controlling the first attaching mechanism, the separating mechanism, and the first rotational drive mechanism;

wherein a transporting route is formed in the printer through which the printing medium is transported, the transporting route including:

a first route extending from a facing position facing the ink-jet head to a first position which is located on the outer peripheral surface and to which the printing medium having been subjected to the printing on a first surface is transferred;

a second route formed on the outer peripheral surface and extending from the first position to a second position at which the printing medium is separated from the first rotatable body by the separating mechanism;

a third route formed on the outer peripheral surface and extending from the second position to the first position; and a fourth route extending from the second position to the facing position;

wherein, when the printing medium is transported, the control mechanism controls the first attaching mechanism, the separating mechanism, and the first rotational drive mechanism such that:

the printing medium is transported through the first route in a state that the printed first surface is exposed;

then the printing medium is transported through the second route and the third route at least once while being attached to the outer peripheral surface of the first rotatable body;

then the printing medium is separated from the first rotatable body by the separating mechanism; and further the printing medium is transported through the fourth route to be transported toward the ink-jet head while a second surface opposite the first surface is exposed;

wherein the control mechanism calculates, based on printing data, a total amount of the ink jetted from the ink-jet head onto the first surface of the printing medium to obtain a printing duty for the printing on the first surface of the printing medium by the ink-jet head;

wherein the control mechanism determines a rotation speed of the first rotatable body based on the obtained printing duty for the printing on the first surface of the printing medium by the ink-jet head; and wherein, when the control mechanism determines the rotation speed of the first rotatable body, the control mechanism sets the rotation speed higher as the obtained printing duty is higher.

2. The printer according to claim 1;

wherein the first rotatable body comprises a first drum having a cylindrical shape.

3. The printer according to claim 1;

wherein the control mechanism determines a total number of rotations of the first drum until the printing medium is separated from the first drum by the separating mechanism, based on a printing duty for the printing on the first surface of the printing medium by the ink-jet head.

4. The printer according to claim 1;

wherein the control mechanism determines a time of continuous rotation of the first drum until the separating mechanism separates the printing medium from the first drum, based on a printing duty for the printing on the first surface of the printing medium by the ink-jet head.

5. The printer according to claim 3;

wherein, when the control mechanism determines the total number of rotations of the first drum, the control mechanism sets the total number of rotations larger as the printing duty is higher.

6. The printer according to claim 1;

wherein the control mechanism controls such that the first drum rotates for a predetermined period of time irrespective of the printing duty.

7. The printer according to claim 4;

wherein, when the control mechanism determines the time of the continuous rotation of the first drum, the control mechanism sets the time of the continuous rotation longer as the printing duty is higher.

8. The printer according to claim 1;

wherein the separating mechanism has a separating member disposed to face the first rotatable body and defining the fourth route; and wherein, when the control mechanism makes the printing medium be separated from the first rotatable body, the control mechanism controls the first attaching mechanism so as to decrease an attachment force of the first rotatable body and causes the printing medium to be transported to the fourth route from the first rotatable body.

9. The printer according to claim 1;

wherein the separating mechanism includes a second rotatable body arranged to face the first rotatable body and defining the fourth route; and a second attaching mechanism attaching the printing medium to a surface of the second rotatable body; and wherein, when the control mechanism makes the printing medium be separated from the first rotatable body, the control mechanism controls the first attaching mechanism to decrease an attaching force of the first rotatable body and controls the second attaching mechanism so as to increase an attaching force of the second rotatable body, such that the printing medium is transported from the first rotatable body to the second rotatable body.

10. The printer according to claim 2, further comprising:

a second drum of which outer peripheral surface faces the ink-jet head;

a second attaching mechanism attaching the printing medium with the second surface being exposed by the first drum to the outer peripheral surface of the second drum while the second surface opposite the first surface is exposed; and a second rotation drive mechanism driving the second rotatable body;

wherein after the ink-jet head performs the printing onto the second surface of the printing medium, the control mechanism controls the second rotation drive mechanism such that the second drum makes one rotation or more while the printing medium is attached to the outer peripheral surface of the second drum by the second attaching mechanism.

11. The printer according to claim 1;

wherein the first rotatable body comprises a belt in a form of an endless belt.

12. The printer according to claim 1;

wherein the control mechanism controls the first rotational drive mechanism to keep the total number of rotations of the first rotatable body constant.

13. The printer according to claim 1;

wherein the attaching mechanism includes:

a fixed body located inside the first rotatable body;

a plurality of decompression chambers located between the first rotatable body and the fixed body, and configured to be decompressed; and a plurality of through holes which is formed to penetrate through the first rotatable body from the outer peripheral surface to the decompression chambers, and via which the printing medium is attached onto the outer peripheral surface;

wherein each of the through holes communicates with each of the decompression chambers in turn as the first rotatable body rotates around the fixed body;

wherein at least one of the through holes, via which the one end of the printing medium is attached, makes a communication with one of the decompression chambers; and wherein the other through holes, other than the at least one of the through holes, do not make a communication with the one of the decompression chambers.

* * * * *